US010954740B2

(12) United States Patent
Budde et al.

(10) Patent No.: US 10,954,740 B2
(45) Date of Patent: Mar. 23, 2021

(54) TOP PLUG WITH TRANSITIONABLE SEAL

(71) Applicant: Weatherford Netherlands, B.V., Den Helder (NL)

(72) Inventors: Marcel Budde, Vlaardingen (NL); Forrest Parker, Manvel, TX (US); Douglas Farley, Missouri City, TX (US)

(73) Assignee: WEATHERFORD NETHERLANDS, B.V., Den Helder (NL)

( * ) Notice: Subject to any disclaimer, the term of this patent is extended or adjusted under 35 U.S.C. 154(b) by 976 days.

(21) Appl. No.: 15/335,118

(22) Filed: Oct. 26, 2016

(65) Prior Publication Data

US 2018/0112487 A1 Apr. 26, 2018

(51) Int. Cl.

| | |
|---|---|
| ***E21B 33/12*** | (2006.01) |
| ***E21B 34/06*** | (2006.01) |
| ***E21B 33/16*** | (2006.01) |
| ***E21B 43/10*** | (2006.01) |
| ***E21B 33/14*** | (2006.01) |
| ***E21B 47/06*** | (2012.01) |

(52) U.S. Cl.

CPC ..... *E21B 33/1208* (2013.01); *E21B 33/14* (2013.01); *E21B 33/16* (2013.01); *E21B 34/06* (2013.01); *E21B 43/10* (2013.01); *E21B 47/06* (2013.01); *E21B 2200/06* (2020.05)

(58) Field of Classification Search

CPC ..... E21B 33/126; E21B 33/13; E21B 33/14; E21B 33/16; E21B 43/10; E21B 33/146; E21B 34/06–16; E21B 47/117

See application file for complete search history.

(56) References Cited

U.S. PATENT DOCUMENTS

| | | | | |
|---|---|---|---|---|
| 2,301,389 A | | 11/1942 | Farris | |
| 2,997,070 A | * | 8/1961 | Penhale | E21B 47/117 138/90 |
| 3,102,595 A | | 9/1963 | Fisher et al. | |
| 3,159,219 A | | 12/1964 | Scott | |
| 3,228,473 A | | 1/1966 | Baker | |

(Continued)

FOREIGN PATENT DOCUMENTS

| | | |
|---|---|---|
| EP | 0846839 A2 | 6/1998 |
| EP | 2256288 A2 | 12/2010 |
| GB | 2397837 A | 8/2004 |

OTHER PUBLICATIONS

Final Office Action in application US 2018-0112488 dated Nov. 21, 2019.

(Continued)

*Primary Examiner* — Robert E Fuller
*Assistant Examiner* — Lamia Quaim
(74) *Attorney, Agent, or Firm* — Patterson + Sheridan, LLP

(57) ABSTRACT

A top latch-in plug includes a housing having a bore; and a transitionable seal, wherein: the transitionable seal seals the bore of the housing when in a first configuration, the transitionable seal unseals the bore when in a second configuration, and the transitionable seal is triggerable to transition from the first configuration to the second configuration. A casing floatation system includes a casing having a pre-load collar and a landing collar; and a lower bottom latch-in plug comprising: a catch mechanism compatible with the pre-load collar; and a landing mechanism compatible with the landing collar.

26 Claims, 25 Drawing Sheets

(56) References Cited

U.S. PATENT DOCUMENTS

| | | | | |
|---|---|---|---|---|
| 3,545,542 | A | 12/1970 | Scott | |
| 3,616,850 | A | 11/1971 | Scott | |
| 3,796,260 | A | 3/1974 | Bradley | |
| 4,164,980 | A | 8/1979 | Duke | |
| 4,362,211 | A | 12/1982 | Fisher, Jr. | |
| 4,378,838 | A | 4/1983 | Ogden et al. | |
| 4,589,495 | A | 5/1986 | Langer et al. | |
| 4,756,365 | A | 7/1988 | Schneider | |
| 4,836,279 | A | 6/1989 | Freeman | |
| 4,907,649 | A | 3/1990 | Bode | |
| 4,966,236 | A | 10/1990 | Braddick | |
| 4,986,361 | A | 1/1991 | Mueller et al. | |
| 5,018,579 | A | 5/1991 | Braddick et al. | |
| 5,117,915 | A | 6/1992 | Mueller et al. | |
| 5,165,473 | A | 11/1992 | Bode | |
| 5,181,571 | A | 1/1993 | Mueller et al. | |
| 5,191,932 | A | 3/1993 | Seefried et al. | |
| 5,435,386 | A | 7/1995 | LaFleur | |
| 5,450,903 | A | 9/1995 | Budde | |
| 5,456,317 | A | 10/1995 | Hood, III et al. | |
| 5,829,526 | A | 11/1998 | Rogers et al. | |
| 5,842,517 | A | 12/1998 | Coone | |
| 6,082,451 | A | 7/2000 | Giroux et al. | |
| 6,457,517 | B1 | 10/2002 | Goodson et al. | |
| 6,561,270 | B1 | 5/2003 | Budde | |
| 6,622,798 | B1 | 9/2003 | Rogers et al. | |
| 6,712,152 | B1 | 3/2004 | Yokley et al. | |
| 9,410,399 | B2 | 8/2016 | Andersen | |
| 10,053,945 | B2 | 8/2018 | Acosta et al. | |
| 10,132,139 | B1 | 11/2018 | Roberts et al. | |
| 2003/0066648 | A1 | 4/2003 | McMahan | |
| 2003/0070816 | A1* | 4/2003 | Sullaway | E21B 43/10 166/380 |
| 2004/0251025 | A1 | 12/2004 | Giroux et al. | |
| 2005/0103492 | A1 | 5/2005 | Szarka | |
| 2006/0124312 | A1 | 6/2006 | Rytlewski et al. | |
| 2007/0261850 | A1 | 11/2007 | Giroux et al. | |
| 2008/0251253 | A1* | 10/2008 | Lumbye | E21B 33/16 166/285 |
| 2010/0147517 | A1 | 6/2010 | D'Arcy | |
| 2012/0234561 | A1 | 9/2012 | Hall et al. | |
| 2013/0105144 | A1 | 5/2013 | Jordan et al. | |
| 2014/0034310 | A1 | 2/2014 | Andersen | |
| 2014/0060848 | A1* | 3/2014 | McMiles | E21B 47/117 166/336 |
| 2014/0102723 | A1 | 4/2014 | Stair | |
| 2014/0138097 | A1* | 5/2014 | Andrigo | E21B 33/16 166/373 |
| 2015/0330181 | A1 | 11/2015 | Budde et al. | |
| 2015/0337624 | A1 | 11/2015 | Themig et al. | |
| 2018/0023362 | A1 | 1/2018 | Makowiecki et al. | |
| 2018/0112487 | A1 | 4/2018 | Budde et al. | |

OTHER PUBLICATIONS

International Preliminary Report on Patentability in related application PCT/US2017/057662 dated Sep. 5, 2019.

International Preliminary Report on Patentability in related applicaiton PCT/US2017/05677 dated Sep. 5, 2019.

PCT International Search Report and Written Opinion for International Application No. PCT/US2017/057677 dated Feb. 6, 2018.

Weatherford; Latch-In Multi PLE Plug System, dated Aug. 17, 2015, 7 pages.

PCT International Search Report and Written Opinion dated Jan. 10, 2018, for International Application No. PCT/US2017/057662.

Office Action in related case U.S. Appl. No. 15/335,215 dated Jul. 11, 2019.

* cited by examiner

TOP PLUG WITH TRANSITIONABLE SEAL

BACKGROUND OF THE INVENTION

Field of the Invention

Embodiments of the present invention generally relate to plugs for casing floatation and/or pressure testing, and methods of use and assembly thereof.

In well completion operations, a wellbore is formed by drilling to access hydrocarbon-bearing formations. After drilling to a predetermined depth, the drill string and drill bit are removed, and a section of casing (or liner or pipe or tubular) is lowered into the wellbore. An annular area is formed between the string of casing and the formation, and a cementing operation may then be conducted to fill the annular area with cement.

In some operations, insertion of casing is problematic due to the characteristics of the wellbore. For example, in a highly deviated wellbore (e.g., high inclination, extended horizontal reach, or multiple directional changes), there may be high friction between the wellbore wall and the casing. In such operations, techniques include filling a section of the casing with a buoyancy fluid (a liquid or a gas) that has a lower density than the liquid contained inside the wellbore. As the casing is lowered into the wellbore, this difference in fluid density provides partial or complete buoyancy of the section of casing containing the buoyancy fluid. This buoyancy may reduce the friction, thus aiding in casing insertion.

Following insertion of the casing, the buoyancy fluid may be removed from the section of casing, either uphole or downhole, depending on factors such as equipment configuration, buoyancy fluid properties, formation properties, operational considerations, etc. Cement may then be pumped through the casing to fill the annular area. Typically a pressure test will follow to confirm the casing and plug connections. Once the casing is free of obstructions, production of formation fluids can begin.

However, equipment and techniques applicable to trapping and releasing buoyancy fluid in a section of casing can often impede cementing, pressure testing, and production. For example, plugs used in trapping buoyancy fluid may obstruct the bore of the casing, requiring drill-out before production. Accordingly, there is a need for an improved equipment and methodology that allows buoyant insertion of casing without additional delay or drilling prior to production.

SUMMARY OF THE INVENTION

The present invention generally provides plugs for casing floatation and/or pressure testing, and methods of use and assembly thereof.

In an embodiment, a top latch-in plug includes a housing having: a head end; a tail end; and a bore from the head end to the tail end; and a transitionable seal, wherein: the transitionable seal seals the bore of the housing when in a first configuration, the transitionable seal unseals the bore when in a second configuration, and the transitionable seal is triggerable to transition from the first configuration to the second configuration.

In an embodiment, a method of well completion includes floating a casing in a wellbore; pumping cement downhole through the casing to supply cement between the casing and the wellbore; sequentially engaging a lower bottom latch-in plug and a top latch-in plug to a landing collar of the casing, wherein the top latch-in plug includes a transitionable seal sealing a bore of the top latch-in plug; pressure testing the casing; and triggering the transitionable seal to unseal the bore of the top latch-in plug.

In an embodiment, a method of well completion includes causing a casing to be floated in a wellbore; causing cement to be pumped downhole through the casing to supply cement between the casing and the wellbore; sequentially engaging a lower bottom latch-in plug and a top latch-in plug to a landing collar of the casing, wherein the top latch-in plug includes a transitionable seal sealing a bore of the top latch-in plug; causing the casing to be pressure tested; and causing a triggering of the transitionable seal to unseal the bore of the top latch-in plug.

In an embodiment, a casing floatation system includes a casing having a pre-load collar and a landing collar; and a lower bottom latch-in plug comprising: a catch mechanism compatible with the pre-load collar; and a landing mechanism compatible with the landing collar.

In an embodiment, a method of well completion includes floating a casing in a wellbore, wherein the casing includes a pre-load collar located uphole from a landing collar, the floating the casing comprising: disposing the casing in the wellbore; disposing buoyancy fluid in the casing between the pre-load collar and the landing collar; and sealing the buoyancy fluid in the casing by engaging a lower bottom latch-in plug with the pre-load collar; discharging the buoyancy fluid from the casing; releasing the lower bottom latch-in plug from the pre-load collar; and engaging the lower bottom latch-in plug with the landing collar.

In an embodiment, a method of assembling a latch-in plug includes obtaining a casing having a pre-load collar and a landing collar; disposing buoyancy fluid in the casing between the pre-load collar and the landing collar; catching a forward portion of a latch-in plug with the pre-load collar, thereby sealing the buoyancy fluid in the casing; and securing an aft portion of the latch-in plug to the forward portion.

In an embodiment, a method of well completion includes causing a casing to be floated in a wellbore, wherein: the casing includes a pre-load collar located uphole from a landing collar, and floating the casing comprises: disposing the casing in the wellbore; disposing buoyancy fluid in the casing between the pre-load collar and the landing collar; and sealing the buoyancy fluid in the casing by engaging a lower bottom latch-in plug with the pre-load collar; discharging the buoyancy fluid from the casing; causing a lower bottom latch-in plug to be released from the pre-load collar; and engaging the lower bottom latch-in plug with the landing collar.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to plugs for casing floatation and pressure testing, and methods of use and assembly thereof.

Figure 1:
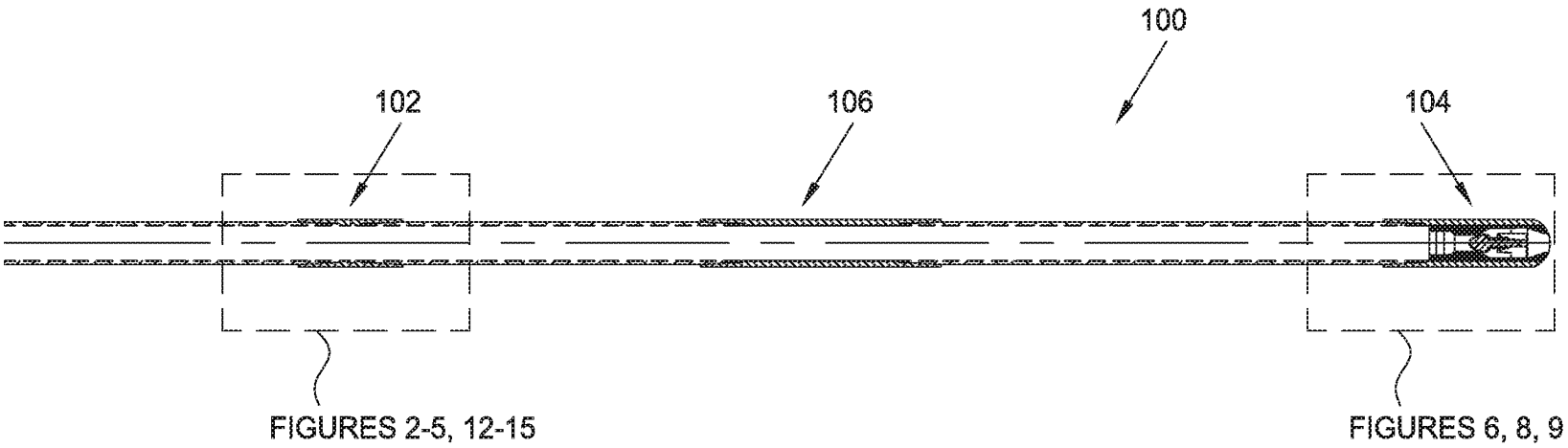
FIG. 1 illustrates a casing having a pre-load collar and a landing collar downhole from the pre-load collar according to embodiments of the invention.

FIG. 1 illustrates a casing 100 having a pre-load collar 102 and a landing collar 104 downhole from the pre-load collar 102. A float shoe with a check valve may be connected at the end of the casing string, downhole from the landing collar 104. The check valve may be biased closed until the pressure inside the casing 100 equals or exceeds the pressure outside the casing 100. For example, the check valve may allow fluid (a liquid or gas) to exit the casing 100 when the pressure inside the casing 100 exceeds the pressure outside the casing 100 by a selected amount. The check valve may close to prevent entry of fluid into the casing 100 when the pressure outside the casing 100 exceeds the pressure inside the casing 100 (or when the pressure inside the casing 100 does not exceed the pressure outside the casing 100 by the selected amount). Between the pre-load collar 102 and the landing collar 104 may be a stimulation tool 106. During operation, the casing 100 will typically be located in a wellbore so that the landing collar 104 is near the bottom of the wellbore. Cement may then be circulated downhole through the casing 100, through the landing collar 104, out of the casing string through the check valve of the float shoe, and uphole through an annulus between the casing 100 and the wellbore. Once the cement sets, the formation surrounding the stimulation tool 106 may be stimulated, for example by perforating the casing 100 at the stimulation tool 106. In some embodiments, one or more toe sleeves may be utilized with, or in lieu of, stimulation tool 106, and may be located near stimulation tool 106, near landing collar 104, or between stimulation tool 106 and landing collar 104. A toe sleeve is a ported collar that is run downhole as part of the casing string. A toe sleeve may be opened (for example, with a pressure signal) to communicate with the wellbore. Multiple toe sleeves may be run, and the toe sleeves may be distributed to cover large production zones or multiple production zones. Typically, to provide a clear (free of cement) communication path through the toe sleeves to the wellbore, a quantity of displacement fluid may be pumped downhole following the pumping of cement (known as "over-displacement" of the cement).

To assist in locating the casing 100 in the wellbore, especially if the wellbore is highly deviated (e.g., high inclination, extended horizontal reach, or multiple directional changes), the casing 100 may be "floated" into the wellbore. In some embodiments, a buoyancy fluid may be disposed in the casing 100 between the pre-load collar 102 and the landing collar 104 prior to moving the casing 100 downhole. For example, the buoyancy fluid may be sealed in the casing 100 between the pre-load collar 102 and the landing collar 104. Suitable buoyancy fluids include a gas, a liquid, or a gas and liquid mixture having a density that is less than the density of the fluid in the wellbore. The lighter density fluid may cause the casing to "float" in the heavier density fluid in the wellbore. In this respect, the buoyancy fluid sealed inside the casing may reduce frictional forces between the casing 100 and the wellbore as the casing 100 is floated into place. In some instances, a heavier pumping fluid may fill the casing 100 uphole from the pre-load collar 102, thereby adding weight to assist with running the casing 100. Suitable pumping fluids include any of a variety of fluids typically pumped in a well completion operation, such as water, mud, drilling fluid, spacer fluid, chemical wash, cement, etc. The buoyancy fluid may be introduced into the casing 100 while the casing 100 is at or near the surface of the wellbore. For example, air at atmospheric pressure may be used as a buoyancy fluid. Other fluids may be introduced into the casing 100 to displace air at atmospheric pressure.

The casing 100 may move downhole while the buoyancy fluid is introduced, or the casing 100 may remain near the surface of the wellbore until the buoyancy fluid is sealed in the casing 100. In some embodiments, the casing 100 with the pre-load collar 102 and landing collar 104 may be constructed prior to introduction into the wellbore. In other embodiments, casing 100 may be constructed in segments. For example, a first casing segment having a landing collar 104 and float shoe may be introduced into the wellbore at the surface. A second casing segment having a stimulation tool 106 may then be connected to the first casing segment, thereby moving the casing 100 downhole by the length of the second casing segment. A third casing segment having a pre-load collar 102 may then be connected to the second casing segment, thereby moving the casing 100 downhole by the length of the third casing segment. The buoyancy fluid may then be introduced into casing 100 and sealed at the downhole end by the check valve of the float shoe, and at the uphole end by coupling a lower bottom latch-in plug 200 in the pre-load collar 102. For example, the check valve may seal the downhole end of the casing 100 by remaining closed in response to the external pressure exceeding the internal pressure (or when the pressure inside the casing 100 does not exceed the pressure outside the casing 100 by the selected amount).

Figure 2:
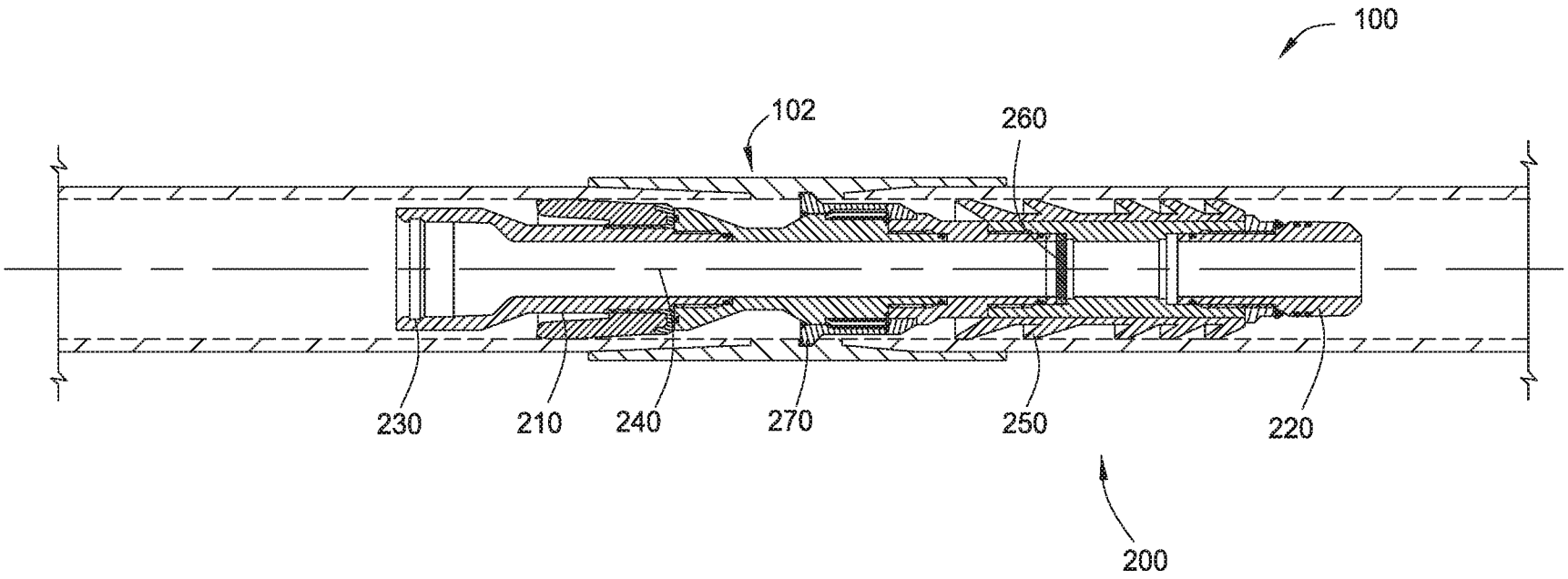
FIG. 2 illustrates a lower bottom latch-in plug caught in a pre-load collar according to embodiments of the invention.

FIG. 2 illustrates a first bottom plug 200 caught in and/or coupled to the pre-load collar 102 of casing 100. As shown, the first bottom plug 200 is a lower bottom latch-in plug 200 having a housing 210, a head end 220, a tail end 230, a bore 240 in the housing 210 extending from the head end 220 to the tail end 230, one or more fins 250, a pressure seal 260, and a catch mechanism 270 that is compatible with, configured to releasably connect with, and/or configured to releasably engage the pre-load collar 102. Head end 220 may have a landing mechanism that is compatible with, configured to connect with, and/or configured to engage landing collar 104. Tail end 230 may have a retaining mechanism to receive other latch-in plugs. Fins 250 may be made of a flexible material, such as rubber or polyurethane, and may extend radially outward and/or at an angle towards the tail end 230. Fins 250 may comprise short fins, long fins or a combination thereof as operationally desired.

Lower bottom latch-in plug 200 is introduced, head end 220 first, into casing 100 behind the buoyancy fluid. Lower bottom latch-in plug 200 forms an uphole seal for the buoyancy fluid. In particular, fins 250 of lower bottom latch-in plug 200 contact and seal against the interior wall of casing 100, and pressure seal 260 of lower bottom latch-in plug 200 seals the bore 240 of lower bottom latch-in plug 200. Once introduced into the casing 100, lower bottom latch-in plug 200 travels downhole through the casing 100, until reaching pre-load collar 102. Lower bottom latch-in plug 200 may travel downhole by gravity, by pumping of a pumping fluid behind the lower bottom latch-in plug 200, or by an assembly tool 800 (discussed below). The catch mechanism 270 causes lower bottom latch-in plug 200 to be caught by the pre-load collar 102. In some embodiments, the catch mechanism 270 may include a collet and a shear ring. The catch mechanism 270 may beneficially provide few or no obstructions in the interior of the casing 100 at the pre-load collar 102 after the lower bottom latch-in plug 200 is released. Once the pre-load collar 102 catches the lower bottom latch-in plug 200, the buoyancy fluid is sealed in the casing 100. The casing 100 may then be moved further downhole in the wellbore until reaching the desired landing location. As used herein, "seal", "sealed", "block", "blocked", and similar wording refers to preventing fluid communication to within acceptable error tolerances. In other words, a bore is "sealed" if no fluid can pass through, but also if fluid can pass through at a rate that is sufficiently low to allow the sealing feature to perform its intended function. As used herein, "unseal", "unsealed", "unblock", "unblocked", and similar wording refers to allowing fluid communication at desired flow rates to within acceptable error tolerances. In other words, a bore is "unsealed" if fluid can pass through at a rate that is sufficiently high to allow the fluid communication feature to perform its intended function.

The pressure seal 260 may operate to seal and/or block the bore 240 at the tail end 230 of the housing 210 until the downhole pressure reaches a specific level, at which point the pressure seal 260 releases, and the bore 240 is no longer blocked. For example, the pressure seal 260 may be a rupture disk that is sensitive to a specific pressure signal. As will be appreciated with the discussion that follows, in some embodiments the pressure seal 260 is selected to release at a downhole pressure that is relatively low, while still being higher than the downhole pressure expected to be used to pump lower bottom latch-in plug 200 downhole to pre-load collar 102. For example, in some embodiments the pressure seal 260 may be a rupture disk configured to rupture at a predetermined pressure such as 2,500 psi.

Once pre-load collar 102 catches lower bottom latch-in plug 200, pumping of pumping fluid behind the lower bottom latch-in plug results in an increase in downhole pressure. Such downhole pressure increase may be detected at the surface as an indication that lower bottom latch-in plug 200 has sealed the buoyancy fluid in the casing 100. Surface operations may shift from pumping of pumping fluid to moving the casing 100 further downhole in the wellbore. Once the casing 100 reaches the desired landing location, surface operations may resume pumping of pumping fluid. Continued pumping of pumping fluid behind the lower bottom latch-in plug results in an increase in downhole pressure until reaching a level that causes pressure seal 260 to release. In some operations, downhole pressures may be monitored, and a selected pressure signal may be used to cause pressure seal 260 to release. The buoyancy fluid, being less dense than the expected wellbore liquids at the intended location for the casing 100, may then travel uphole through bore 240. Likewise, the pumping fluid behind the lower bottom latch-in plug may replace the buoyancy fluid in the casing 100 between the pre-load collar 102 and the landing collar 104. In some embodiments, some or all of the buoyancy fluid may exit the casing 100 through the landing collar 104 and through the check valve of the float shoe. The buoyancy fluid may thus be discharged from the casing 100.

Figure 3:
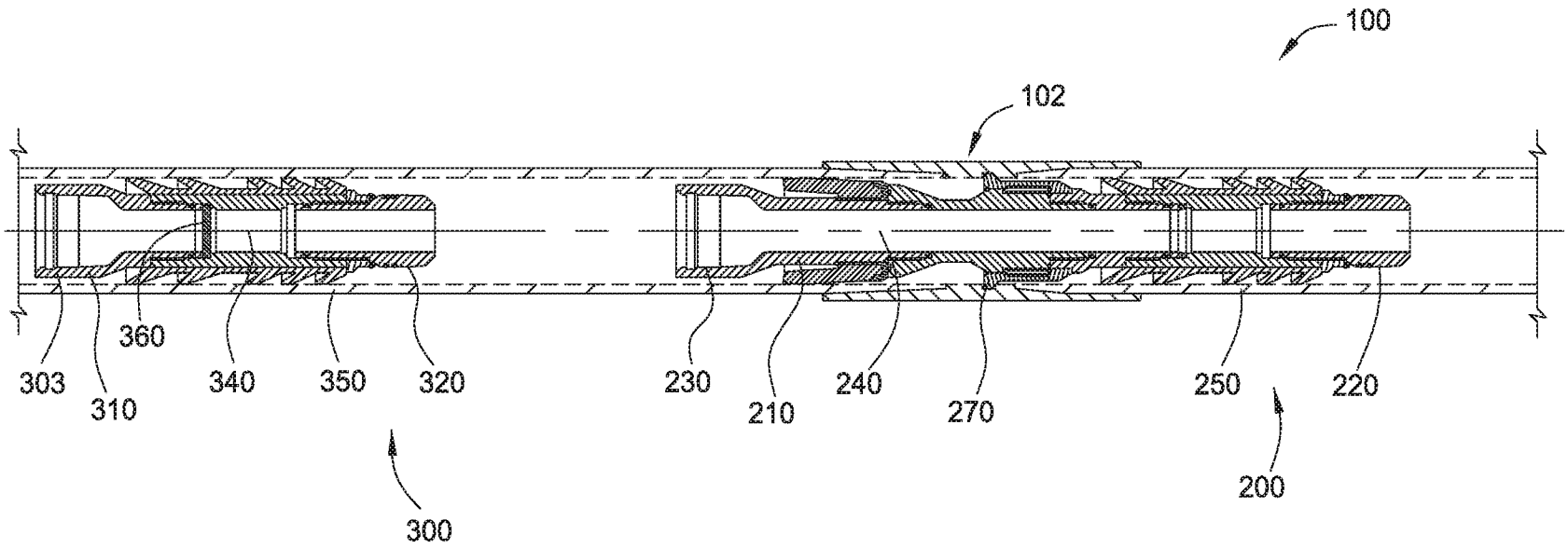
FIG. 3 illustrates an upper bottom latch-in plug uphole from a pre-load collar according to embodiments of the invention.

FIG. 3 illustrates a second bottom plug 300 uphole from pre-load collar 102 of casing 100. As shown, the second bottom plug 300 is an upper bottom latch-in plug 300 having a housing 310, a head end 320, a tail end 330, a bore 340 in the housing 310 extending from the head end 320 to the tail end 330, one or more fins 350, and a pressure seal 360. Fins 350 may be made of a flexible material, such as rubber or polyurethane, and may extend radially outward and/or at an angle towards the tail end. Fins 350 may comprise short fins, long fins or a combination thereof as operationally desired. Upper bottom latch-in plug 300 is introduced, head end 320 first, into casing 100 and travels downhole through the casing 100, until reaching lower bottom latch-in plug 200. Upper bottom latch-in plug 300 may travel downhole by gravity and/or by pumping of a pumping fluid behind the upper bottom latch-in plug 300.

Figure 4:
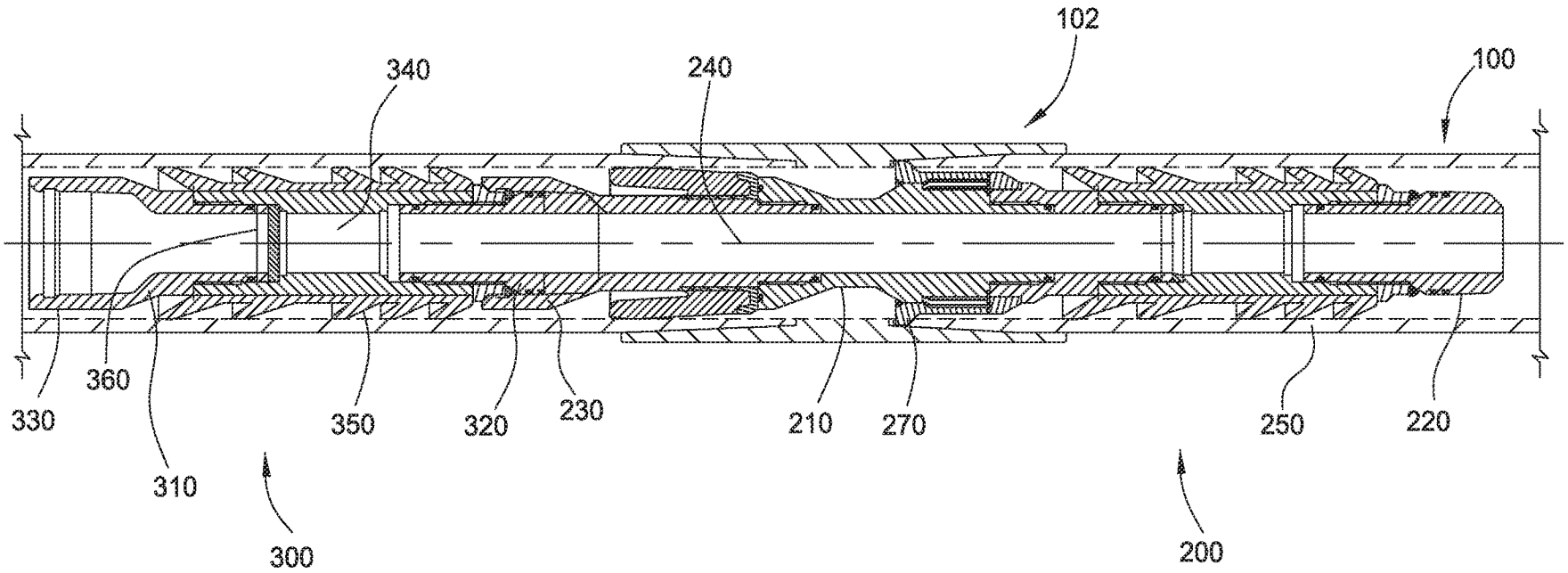
FIG. 4 illustrates an upper bottom latch-in plug latched-in with a lower bottom latch-in plug according to embodiments of the invention.

FIG. 4 illustrates the upper bottom latch-in plug 300 latched-in with and/or engaged with lower bottom latch-in plug 200. The head end 320 of upper bottom latch-in plug 300 is designed to mate with the tail end 230 of lower bottom latch-in plug 200, thereby coupling the upper bottom latch-in plug 300 to the lower bottom latch-in plug 200. For example, a retaining mechanism may be used to latch-in upper bottom latch-in plug 300 with lower bottom latch-in plug 200. An example of a suitable retaining mechanism is available from Weatherford® as described in product brochure Doc No. 5-3-GL-GL-CES-00029, Revision 2, Date 17 Aug. 2015. The combined upper bottom latch-in plug 300 and lower bottom latch-in plug 200 will be referred to as "bottom latch-in plug 200/300."

Figure 5:
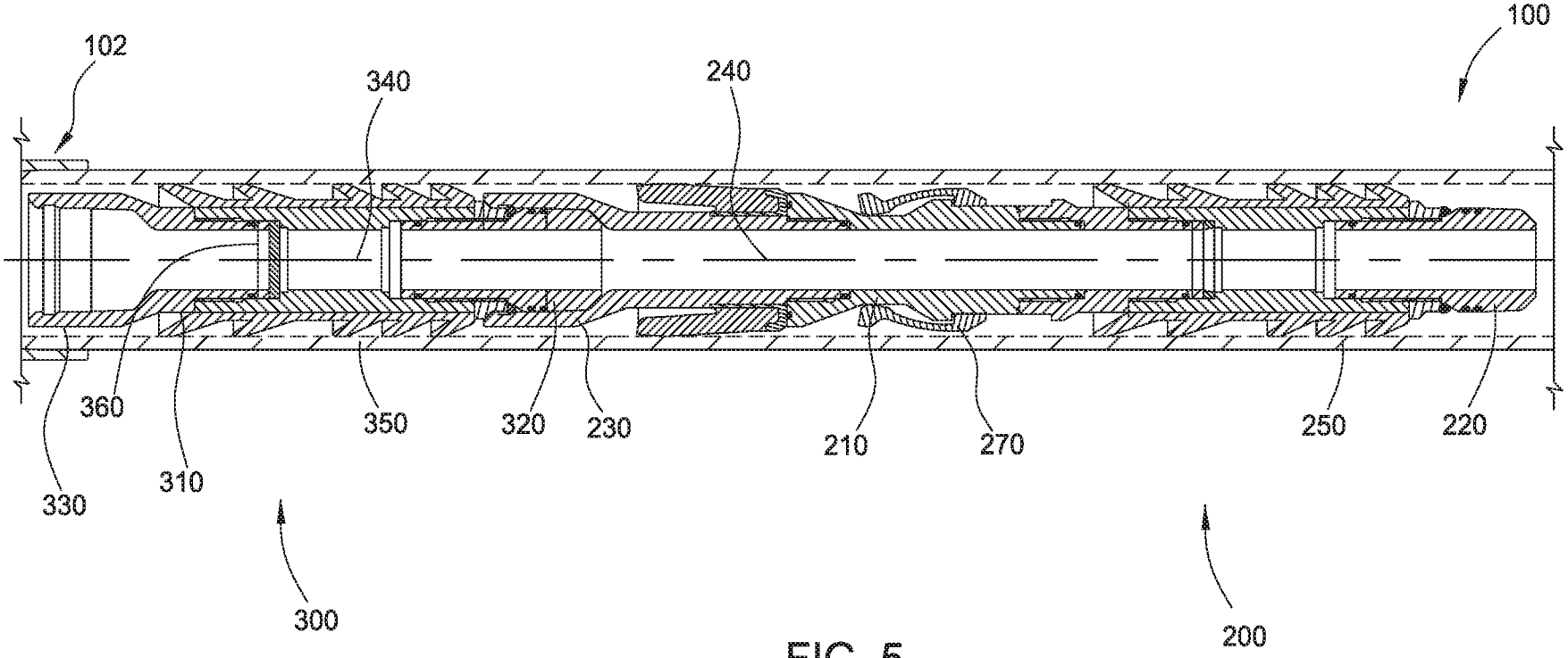
FIG. 5 illustrates a bottom latch-in plug released from a pre-load collar according to embodiments of the invention.

Continued pumping of pumping fluid behind the bottom latch-in plug 200/300 raises the downhole pressure. The catch mechanism 270 is designed to release in response to a selected pressure signal. It should be appreciated that the level of downhole pressure selected for the pressure signal to cause the catch mechanism 270 to release may be greater than the level of downhole pressure selected to release for previously-discussed pressure seal 260. For example, in some embodiments the catch mechanism 270 may utilize a 3000 psi shear ring. Once the downhole pressure rises to the selected level, catch mechanism 270 releases, and the bottom latch-in plug 200/300 moves downhole from pre-load collar 102, as illustrated in FIG. 5.

In some embodiments, the pumping fluid behind bottom latch-in plug 200/300 includes cement. Bottom latch-in plug 200/300 may wipe the interior surface of casing 100 in advance of the cement. The pumping fluid may also include one or more chemical washes and/or spacer fluids to better prepare the interior of casing 100 for the cement.

Figure 6:
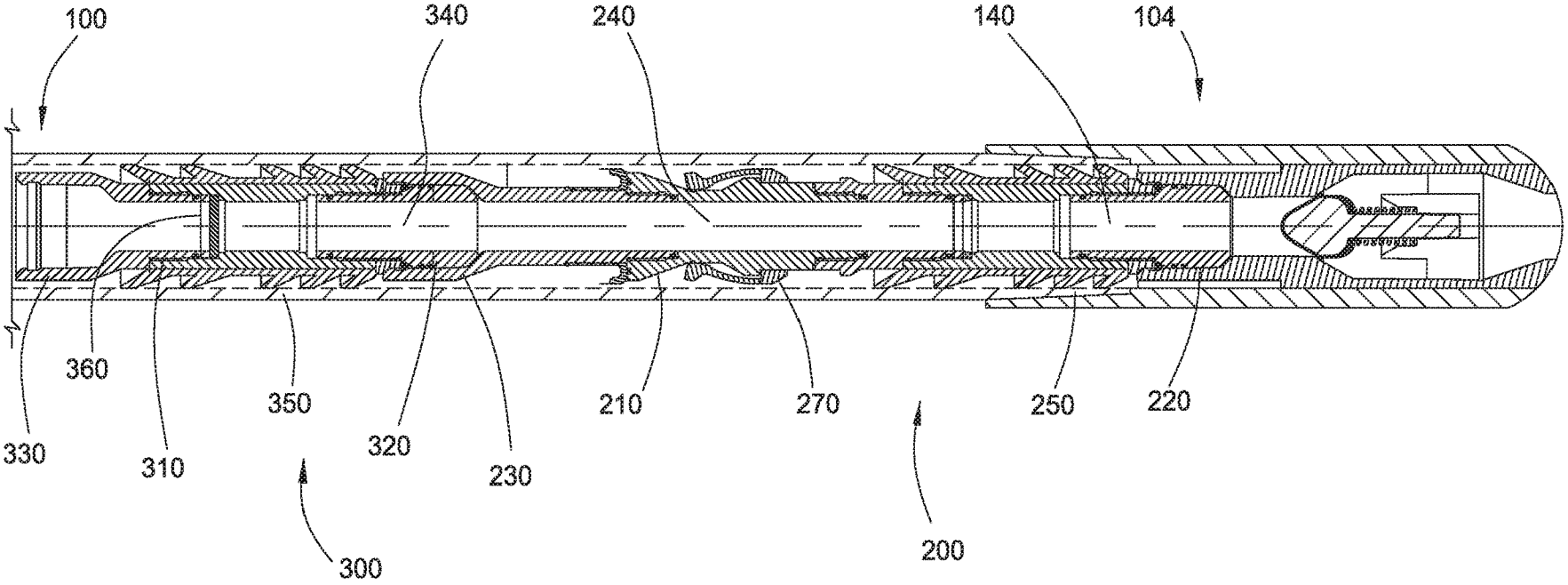
FIG. 6 illustrates a bottom latch-in plug proximate to a landing collar according to embodiments of the invention.

As illustrated in FIG. 6, bottom latch-in plug 200/300 travels downhole until it reaches landing collar 104. Bottom latch-in plug 200/300 then latches-in with landing collar 104. The head end 220 of lower bottom latch-in plug 200 is designed to mate with and securely couple to landing collar 104. For example, a landing mechanism may be used to latch-in bottom latch-in plug 200/300 with landing collar 104. Commonly available landing mechanisms may be used to meet operational needs.

Continued pumping of pumping fluid (including cement) behind the bottom latch-in plug 200/300 raises the downhole pressure. Such downhole pressure increase may be detected at the surface as an indication that bottom latch-in plug 200/300 has reached the landing collar 104. Continued pumping of pumping fluid (including cement) behind the bottom latch-in plug 200/300 results in an increase in downhole pressure until reaching a level that causes pressure seal 360 to release. In some operations, downhole pressures may be monitored, and a selected pressure signal may be used to cause pressure seal 360 to release. It should be appreciated that the level of downhole pressure selected for the pressure signal to cause the pressure seal 360 to release may be greater than the level of downhole pressure selected for previously-discussed catch mechanism 270. For example, in some embodiments the pressure seal 360 may be a 4000 psi rupture disk. Release of pressure seal 360 opens the bore 240/340 of bottom latch-in plug 200/300. Cement can thus be pumped through the casing 100, the bottom latch-in plug 200/300, the landing collar 104, and the check valve of the float shoe to enter and/or fill the annulus between the casing 100 and the wellbore. In some embodiments, a quantity of displacement fluid may be pumped through the casing 100 behind the cement. For example, when one or more toe sleeves are utilized, a sufficient quantity of displacement fluid may be pumped to over-displace the cement, allowing for a clear (free of cement) communication path between the toe sleeves and the wellbore.

Figure 7A:
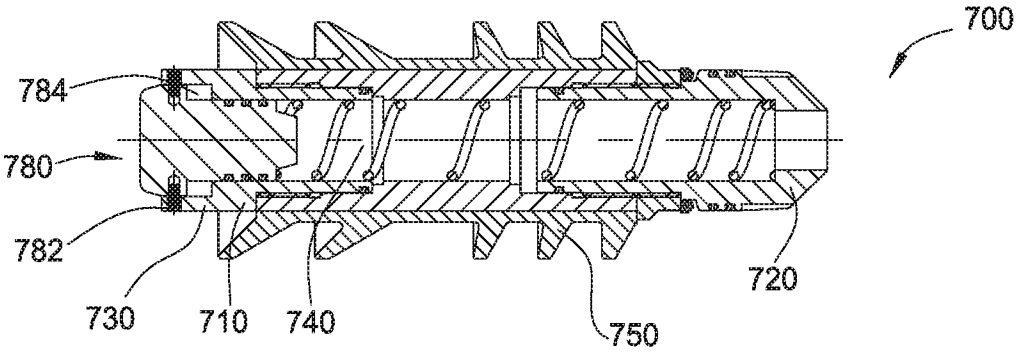
FIGS. 7 A-C illustrate a top latch-in plug according to embodiments of the invention.
Figure 7B:
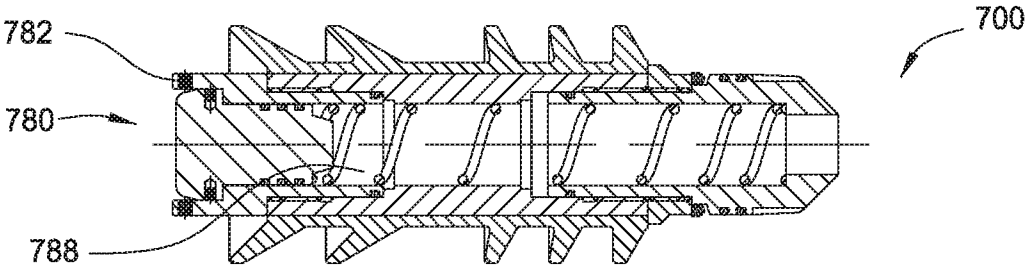

Following the desired amount of cement and/or displacement fluid, a top plug is introduced into casing 100, as illustrated in FIGS. 7 A-C. As shown, the top plug is a top latch-in plug 700 having a housing 710, a head end 720, a tail end 730, a bore 740 in the housing 710 extending from the head end 720 to the tail end 730, and one or more fins 750. Fins 750 may be made of a flexible material, such as rubber or polyurethane, and may extend radially outward and/or at an angle towards the tail end. Fins 750 may comprise short fins, long fins or a combination thereof as operationally desired. Top latch-in plug 700 also includes a transitionable seal. In some embodiments, the transitionable seal may be a cap (for example, expendable cap 780, discussed below). In the initial configuration (when top latch-in plug 700 is introduced into and pumped down casing 100), the cap 780 seals the bore 740 at the tail end 730 of the housing 710. Top latch-in plug 700 is introduced, head end 720 first, into casing 100 and travels downhole through the casing 100, until reaching bottom latch-in plug 200/300. Top latch-in plug 700 may travel downhole by gravity and/or by pumping of a pumping fluid behind the top latch-in plug 700. In some embodiments, the pumping fluid behind the top latch-in plug may be a tail slurry and/or displacement fluid. It should be appreciated that the tail slurry may be free of cement or other materials that might obstruct casing 100, stimulation tool 106, any toe sleeves, the float shoe, the check valve, and/or bores 740, 340, 240, 140 (see FIG. 9) after pressure testing.

Figure 8:
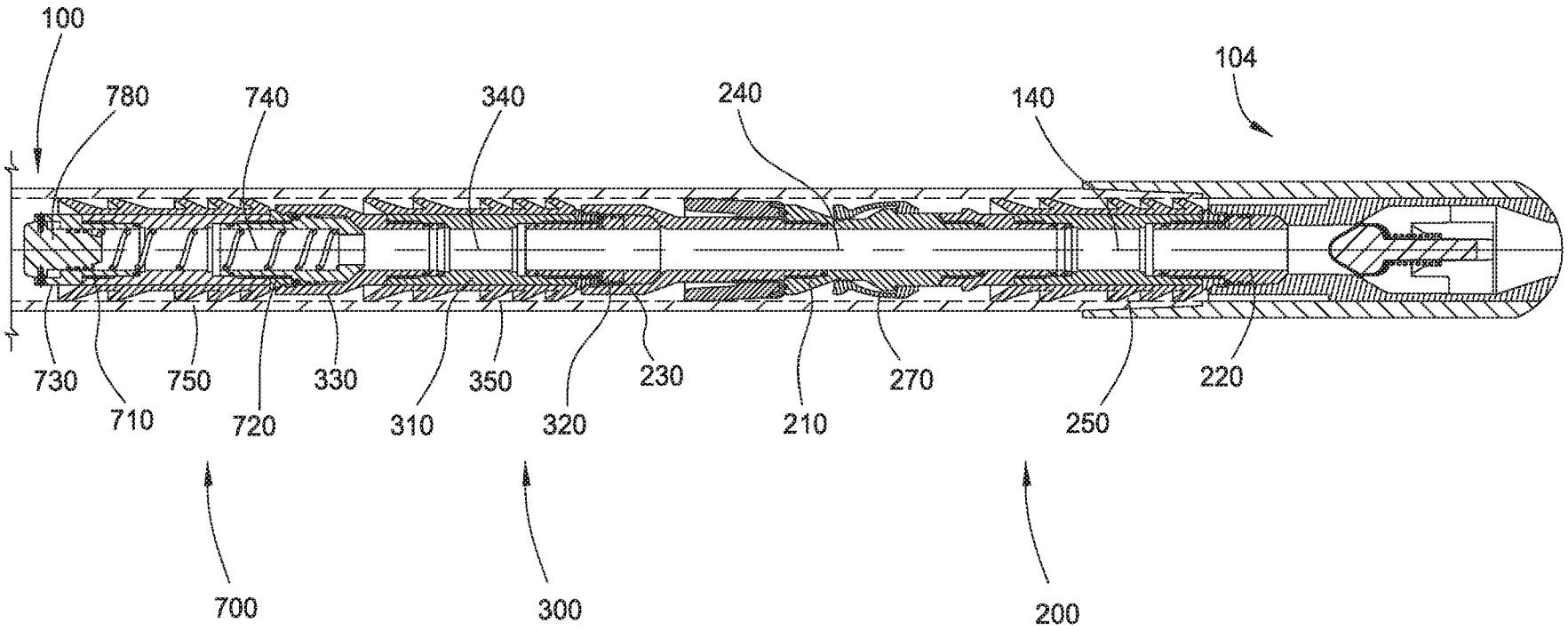
FIG. 8 illustrates a top latch-in plug proximate to a bottom latch-in plug according to embodiments of the invention.

As illustrated in FIG. 8, top latch-in plug 700 travels downhole until it reaches bottom latch-in plug 200/300. Top latch-in plug 700 then latches-in with bottom latch-in plug 200/300. The head end 720 of top latch-in plug 700 is designed to mate with and securely couple to the tail end 330 of upper bottom latch-in plug 300. For example, a retaining mechanism may be used to latch-in top latch-in plug 700 with upper bottom latch-in plug 300. An example of a suitable retaining mechanism is available from Weatherford® as described in product brochure Doc No. 5-3-GL-GL-CES-00029, Revision 2, Date 17 Aug. 2015, which is incorporated herein. Note that lower bottom latch-in plug 200 is latched-in with landing collar 104, that upper bottom latch-in plug 300 is latched-in with lower bottom latch-in plug 200, and that top latch-in plug is latched-in with upper bottom latch-in plug 300. Any of the latch-in plugs may be thereby considered sequentially latched-in with the downhole latch-in plugs and/or landing collar 104.

Continued pumping of pumping fluid behind the top latch-in plug 700 raises the downhole pressure. Such downhole pressure increase may be detected at the surface as an indication that top latch-in plug 700 has reached the landing collar 104. This may be an indication that most or all of the cement has traveled downhole through the casing 100, the bottom latch-in plug 200/300, the landing collar 104, and the check valve of the float shoe to enter and/or fill the annulus between the casing 100 and the wellbore. Surface operations may shift to allow the cement in the annulus to harden, forming a cement shell around casing 100. After it is determined that the cement has hardened (for example, with the passage of a period of time), the casing and/or the plug connections may be pressure tested. In other words, downhole pressure may be increased and held over time to confirm that the casing 100 is capable of withstanding certain downhole pressures. Some types of pressure tests include one or more pressure levels, each held for a designated period of time. It should be appreciated that the level of downhole pressure selected for the lowest pressure level of the pressure test may be greater than the level of downhole pressure selected for previously-discussed pressure seal 360. For example, in some embodiments the downhole pressure during the pressure test may be between about 10 k psi and 12 k psi. It is currently believed that downhole pressure greater than about 12 k psi may rupture the casing 100.

In conjunction with and/or following the pressure test, the transitionable seal of top latch-in plug 700 may be triggered to transition from sealing the bore 740 to unseal the bore 740. In some embodiments, the transitionable seal may be triggered to transition with a pressure signal. In some embodiment, the transitionable seal may be triggered to transition with multi-step triggering. For example, a first triggering event may initiate the transition, a second triggering event may advance the transition, and the transitionable seal may transition from sealing the bore 740 to unseal the bore 740. In some embodiments, the transitionable seal may be triggered to transition with a multi-step pressure signal. In some embodiments, following the pressure test, an expendable cap 780 may transition from sealing the bore 740 to unseal the bore 740. In one configuration of such embodiment, the expendable cap 780 seals the bore 740 at the tail end 730 of the housing 710 of top latch-in plug 700. For example, in the configuration illustrated in FIG. 7A, the expendable cap 780 seals the bore 740 at the tail end 730 of the housing 710. In some embodiments, the expendable cap 780 may have a lid portion 781 and a stopper portion 785. There may be a recess 784 between the lid portion 781 and the housing 710. The stopper portion 785 may sealingly fit in the bore 740. One or more O-rings 786 may be located around the stopper portion 785 to create a seal with the interior of the housing 710. Other configurations may be envisioned so that the expendable cap 780 may seal the bore 740 at the tail end 730 of the housing 710. The expendable cap 780 may be triggered to transition from a configuration wherein the expendable cap 780 seals the bore 740 at the tail end 730 of the housing 710 to a configuration wherein expendable cap 780 unseals the bore 740. For example, the expendable cap 780 may unseal the bore 740 by blocking no more than half of a cross-sectional area 790 of the bore 740 at the tail end 730 of the housing 710, as in the configuration illustrated in FIG. 7C. In the illustrated embodiment, a spring element 788 is located in the bore 740 and, when compressed by expendable cap 780, is biased to eject the expendable cap 780 from the housing 710. Other post-triggered configurations may be envisioned so that the expendable cap 780 unseals the bore 740. In some embodiments, the transitionable seal may seal the bore of the housing in a post-triggered configuration. For example, in the configuration illustrated in FIG. 7B, the expendable cap 780 seals the bore 740 at the tail end 730 of the housing 710. Other transitionable seals of top latch-in plug 700 may be envisioned so that, in conjunction with and/or following the pressure test, the transitionable seal may be triggered to transition from sealing the bore 740 to unseal the bore 740, such as with a hydraulic port collar, a sliding sleeve, or a staging baffle plate (see for example the discussion in relation to FIGS. 10 and 11 below).

Figure 7C:
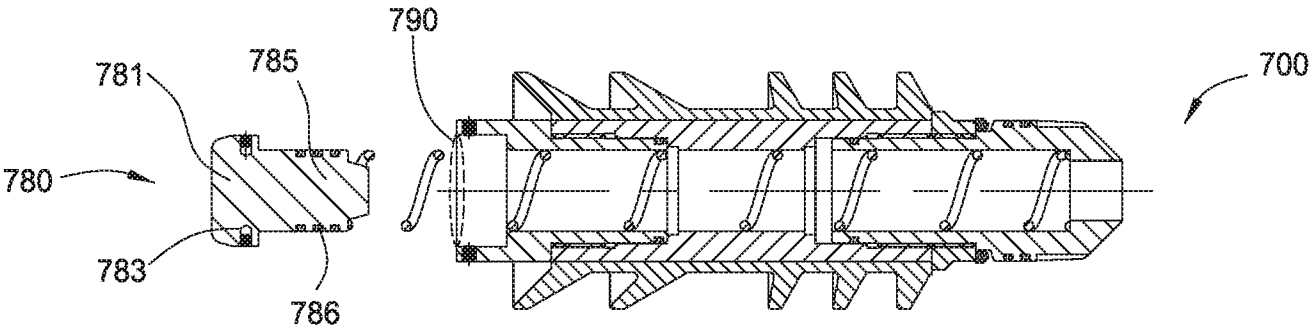

The transitionable seal may be triggered to transition from sealing the bore 740 to unseal the bore 740, but the transitionable seal may seal the bore 740 at least until completion of the pressure test. In some embodiments, the completion of the pressure test may be indicated by a pressure-drop signal proximate the tail end 730 of the housing 710. The transitionable seal may thereby seal the bore of the housing in a post-triggered configuration. For example, in the illustrated embodiment, the lid portion 781 of expendable cap 780 may have one or more shear pin receptacles 783 for receiving shear pins 782. The shear pins 782 hold the expendable cap 780 in the housing 710. The shear pins 782 are designed to shear in response to a selected pressure signal. In some embodiments, the level of downhole pressure selected for the pressure signal to cause the shear pins 782 to shear may be greater than the level of downhole pressure selected for the previously-discussed pressure seal 360. For example, in some embodiments the shear pins 782 may be 11 k psi shear pins. Moreover, the transitionable seal may seal the bore 740 at least until the completion of the previously-discussed pressure test, as indicated by a pressure-drop signal. Therefore, while the level of downhole pressure selected for the pressure signal to cause the shear pins 782 to shear may be near, at, or above the level of downhole pressure selected for the lowest pressure level of the pressure test, the transitionable seal may seal the bore 740 until downhole pressure drops to a level below the level of downhole pressure selected for the lowest pressure level of the pressure test. As illustrated, at the selected downhole pressure for triggering the expendable cap 780, the shear pins 782 shear, allowing the lid portion 781 of expendable cap 780 to enter the recess 784. This further compresses spring element 788 in bore 740. The spring element 788 may be biased to apply pressure to the expendable cap 780 in a direction away from housing 710. In some embodiments, the downhole pressure may be increased, possibly in conjunction with a pressure test, thereby holding the lid portion 781 in the recess 784. In some embodiments, the force of compressed spring element 788 is sufficient to overcome the downhole pressure and eject expendable cap 780 (as illustrated in FIG. 7C). In some embodiments, pumping pressure may be reduced to provide a pressure-drop signal, for example at the end of the pressure test, so that the force of compressed spring element 788 is sufficient to overcome the downhole pressure and eject expendable cap 780. In some embodiments, spring element 788 includes small charges, electromagnets, or other devices to provide impulsive force to assist in ejecting expendable cap 780. In some embodiments, spring element 788 may be replaced by a reservoir of dissolving fluid. For example, movement of expendable cap 780 into recess 784 may puncture the reservoir of dissolving fluid, causing expendable cap 780 to at least partially dissolve over a period of time. As discussed below in relation to FIGS. 10 and 11, other configurations may be envisioned so that, in conjunction with and/or following the pressure test, the transitionable seal may be triggered to transition from sealing the bore 740 to unseal the bore 740, such as with a hydraulic port collar, a sliding sleeve, or a staging baffle plate.

Figure 9:
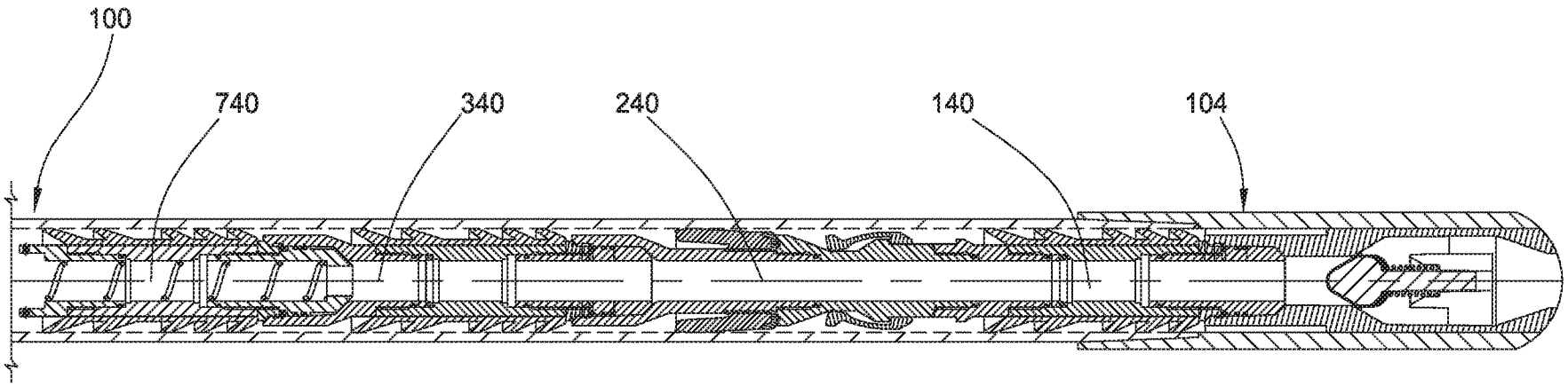
FIG. 9 illustrates an unsealed top latch-in plug proximate to a bottom latch-in plug that is proximate to a landing collar according to embodiments of the invention.

As illustrated in FIG. 9, once the transitionable seal has transitioned from sealing the bore 740 to unseal the bore 740, the casing 100 has an open pathway through bores 740, 340, 240, 140 to reach the formation through the check valve of the float shoe. In some embodiments, the check valve may be opened or disabled to allow fluid flow from the wellbore into the casing 100 through the open pathway. For example, the check valve may be sheared-out of the float shoe with a pressure signal. In other embodiments, the check valve may be otherwise opened with a pressure signal, an electronic signal, a wireless signal, or another suitable signal. In some embodiments, one or more toe sleeves may be opened to allow fluid to flow from the wellbore into the casing 100. For example, the toe sleeves may be opened with a pressure signal, an electronic signal, a wireless signal, or another suitable signal. Stimulation of the formation and/or production of formation fluids from downhole in the wellbore can then begin. For example, stimulation fluids (e.g., fracturing or acidizing fluids) may be pumped downhole through the casing 100 and the bores 740, 340, 240, 140. As another example, formation fluids may be produced from downhole through the bores 140, 240, 340, 740, and the casing 100. In some embodiments, following the pressure test, casing 100 may be perforated to allow for stimulation of and/or fluid production from the formation around stimulation tool 106. In some embodiments, expendable cap 780 travels uphole with the production fluids. Top latch-in plug 700 and bottom latch-in plug 200/300 may remain latched-in with landing collar 104 during production of fluids through casing 100. In some embodiments, one or more of the latch-in plugs 200, 300, 700 may have an anti-rotation feature, such as an anti-rotation mill profile, locking teeth, and/or plug inserts, which would allow for more efficient drill-out. For example, were it desirable to further open casing 100, latch-in plugs 200, 300, 700 may be drilled-out. Rather than rotating in response to the drill-out tool, the anti-rotation feature of the latch-in plugs 200, 300, 700 would at least partially resist the rotational forces of the drill.

FIG. 10 illustrates an alternative top plug as an example of other envisioned configurations that provide a transitionable seal that, in conjunction with and/or following a pressure test, may be triggered to transition from sealing the bore 740 to unseal the bore 740. As shown, the top plug is a top latch-in plug 700' having a housing 710', a head end 720', a tail end 730', a bore 740' in the housing 710' extending from the head end 720' to the tail end 730', and one or more fins 750'. Top latch-in plug 700' also includes a transitionable seal. In some embodiments, the transitionable seal may be a sleeve (for example, sleeve 880, discussed below). In the initial configuration shown in FIG. 10A (when top latch-in plug 700' is introduced into and pumped down casing 100), the sleeve 880 seals the bore 740' of the housing 710'.

As with top latch-in plug 700, top latch-in plug 700' may latch-in with bottom latch-in plug 200/300. The casing and/or the plug connections may be pressure tested. In conjunction with and/or following the pressure test, the transitionable seal of top latch-in plug 700' may be triggered to transition from sealing the bore 740' to unseal the bore 740'. In some embodiments, following the pressure test, a sleeve 880 may transition from sealing the bore 740' to unseal the bore 740'. For example, in the configuration illustrated in FIG. 10A, the sleeve 880 seals the bore 740' of the housing 710' by blocking ports 885. In some embodiments, the sleeve 880 may have a lid portion 781' and a stopper portion 785'. There may be a recess 784' between the stopper portion 785' and the housing 710'. In the illustrated embodiment, a spring element 788' is located in recess 784' of the housing 710', biasing the sleeve 880 towards the tail end 730' of the housing 710'. The stopper portion 785' may sealingly fit in the bore 740'. One or more O-rings 786' may be located around the stopper portion 785' to create a seal with the interior of the housing 710'. Other configurations may be envisioned so that the sleeve 880 may seal the bore 740' of the housing 710'. The sleeve 880 may be triggered to transition from a configuration wherein the sleeve 880 seals the bore 740' of the housing 710' to a configuration wherein sleeve 880 unseals the bore 740'. For example, the sleeve 880 may unseal the bore 740' as in the configuration illustrated in FIG. 10C, wherein ports 885 are shown fluidly connected to bore 740' through sleeve passages 890. As illustrated, housing 710' has four ports 885, and sleeve 880 has four sleeve passages 890, but various numbers, sizes, and distributions of ports 885 and sleeve passages 890 may be envisioned to accommodate operational requirements and designs. Further, other post-triggered configurations may be envisioned so that the sleeve 880 unseals the bore 740'.

As with top latch-in plug 700, the transitionable seal of top latch-in plug 700' may be triggered to transition from sealing the bore 740' to unseal the bore 740', and the transitionable seal may seal the bore 740' at least until completion of the pressure test. In some embodiments, the completion of the pressure test may be indicated by a pressure-drop signal proximate the tail end 730' of the housing 710'. For example, in the illustrated embodiment, the lid portion 781' of sleeve 880 may have one or more shear pin receptacles 783' for receiving shear pins 782'. The shear pins 782' hold the sleeve 880 in the housing 710'. The shear pins 782' are designed to shear in response to a selected pressure signal. The transitionable seal may seal the bore 740' at least until the completion of the previously-discussed pressure test, as indicated by a pressure-drop signal. While the level of downhole pressure selected for the pressure signal to cause the shear pins 782' to shear may be near, at, or above the level of downhole pressure selected for the lowest pressure level of the pressure test, the transitionable seal may seal the bore 740' until downhole pressure drops to a level below the level of downhole pressure selected for the lowest pressure level of the pressure test. As illustrated, at the selected downhole pressure for triggering the sleeve 880, the shear pins 782' shear, compressing the stopper portion 785' against spring element 788'. This further compresses spring element 788' in the recess 784'.

Figure 10A:
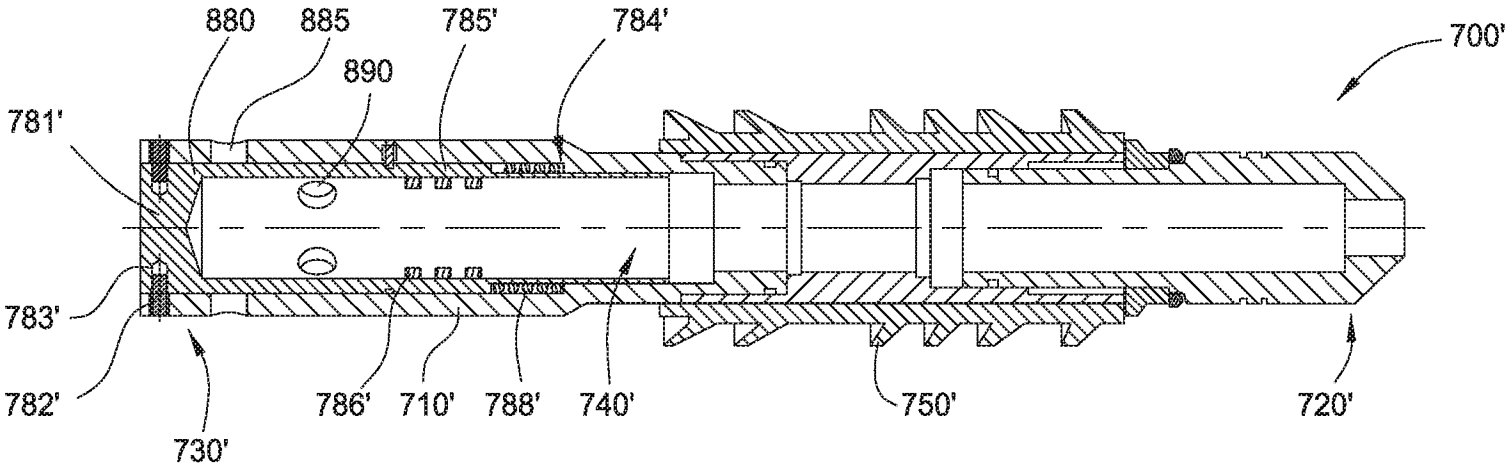
FIGS. 10 A-D illustrate an alternative top latch-in plug according to embodiments of the invention.
Figure 10B:
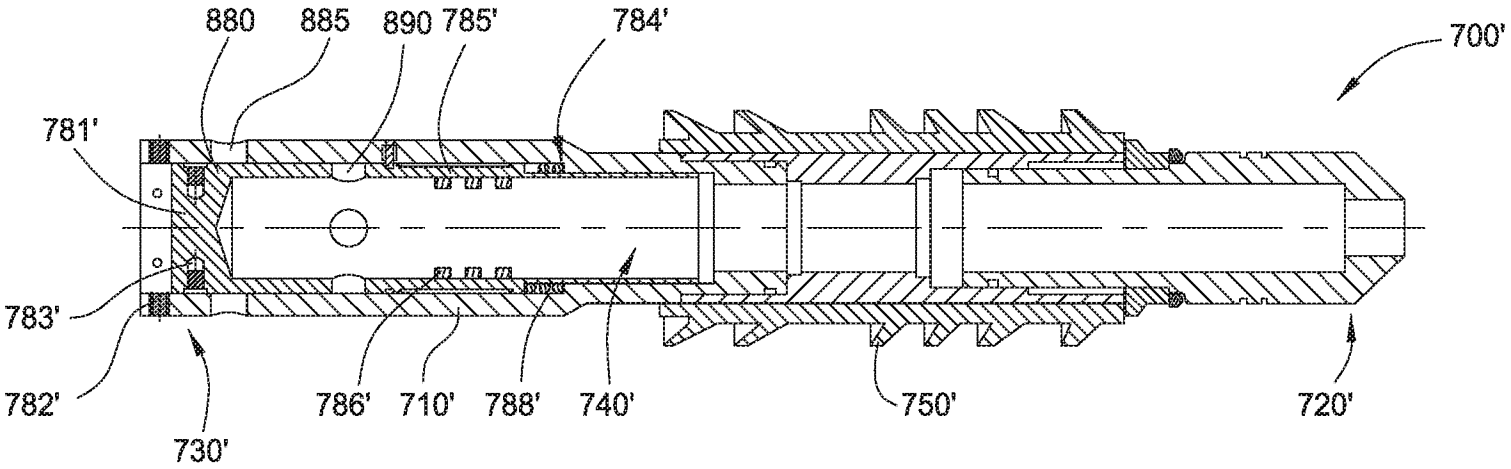
Figure 10C:
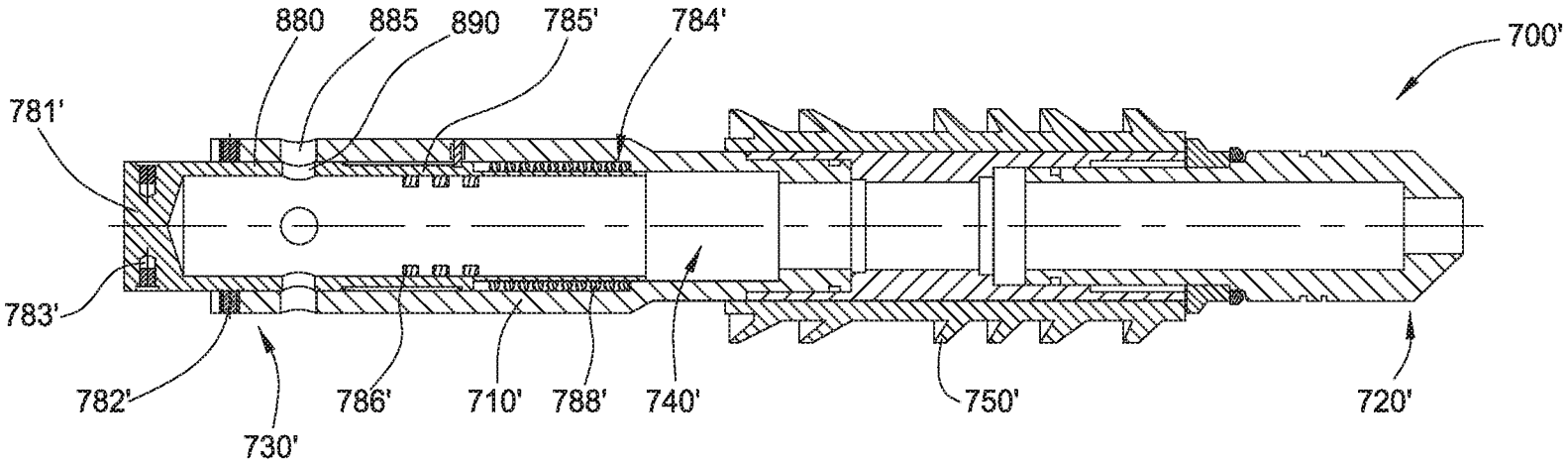
Figure 10D:
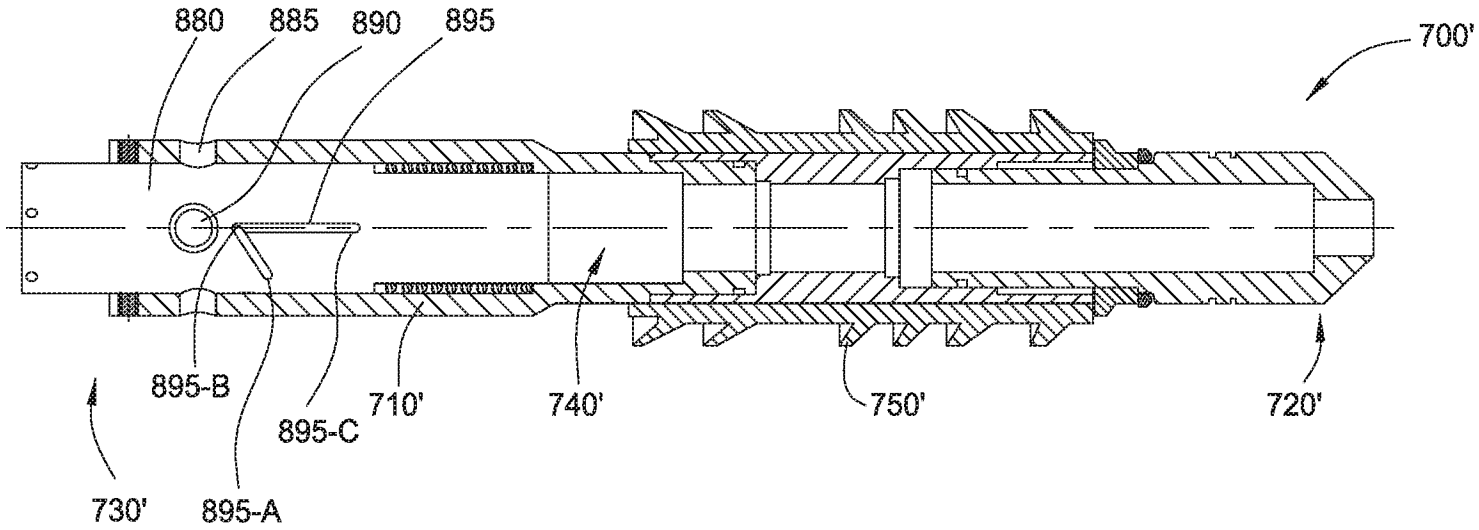

As illustrated in FIG. 10D, there may be a J-slot 895 on the exterior of sleeve 880. A pin on an interior surface of housing 710' may engage the J-slot 895. In the initial configuration shown in FIG. 10A (when top latch-in plug 700' is introduced into and pumped down casing 100), the pin may engage J-slot 895 at point 895-A. In addition to shearing of shear pins 782', triggering the sleeve 880 may further include moving the pin relative to J-slot 895 from point 895-A to point 895-B. Sleeve 880 may thereby rotate relative to housing 710'. Sleeve 880 blocks ports 885 of housing 710' both with the pin in J-slot 895 at point 895-A and with the pin in J-slot 895 at point 895-B. Sleeve 880 thereby seals the bore 740' when the pin is in J-slot 895 at point 895-A and at point 895-B. In some embodiments, following triggering sleeve 880 with a selected downhole pressure, the downhole pressure may be increased, possibly in conjunction with a pressure test, thereby holding the pin in J-slot 895 point 895-B (as illustrated in FIG. 10B). The transitionable seal may thereby seal the bore of the housing in a post-triggered configuration. In some embodiments, the force of compressed spring element 788' is sufficient to overcome the downhole pressure and move the pin relative to J-slot 895 from point 895-B to point 895-C. Sleeve 880 aligns sleeve passages 890 with ports 885 of housing 710' with the pin in J-slot 895 at point 895-C. Sleeve 880 thereby unseals the bore 740' when the pin is in J-slot 895 at point 895-C. In some embodiments, pumping pressure may be reduced to provide a pressure-drop signal, for example at the end of the pressure test, so that the force of compressed spring element 788' is sufficient to overcome the downhole pressure and move the pin to point 895-C (as illustrated in FIG. 10C). In some embodiments, spring element 788' includes small charges, electromagnets, or other devices to provide impulsive force to assist in moving pin to point 895-C. In some embodiments, subsequent pressure signals (either pressure increases or pressure decreases) may further move the pin relative to the J-slot 895, thereby rotating sleeve 880 to either seal or unseal the bore 740' of the housing 710'. A variety of other configurations may be envisioned so that, in conjunction with and/or following the pressure test, the transitionable seal may be triggered to transition from sealing the bore 740 to unseal the bore 740.

FIG. 11 illustrates another alternative top plug as an example of other envisioned configurations that provide a transitionable seal that, in conjunction with and/or following a pressure test, may be triggered to transition from sealing the bore 740 to unseal the bore 740. As shown, the top plug is a top latch-in plug 700" having a housing 710", a head end 720", a tail end 730", a bore 740" in the housing 710" extending from the head end 720" to the tail end 730", and one or more fins 750". Top latch-in plug 700" also includes a transitionable seal. In some embodiments, the transitionable seal may be a sleeve (for example, sleeve 880', discussed below). In the initial configuration shown in FIG. 11A (when top latch-in plug 700" is introduced into and pumped down casing 100), the sleeve 880' seals the bore 740" of the housing 710".

As with top latch-in plug 700, top latch-in plug 700" may latch-in with bottom latch-in plug 200/300. The casing and/or the plug connections may be pressure tested. In conjunction with and/or following the pressure test, the transitionable seal of top latch-in plug 700" may be triggered to transition from sealing the bore 740" to unseal the bore 740". In some embodiments, the triggering may be a multi-step triggering. For example, a first triggering event may initiate the transition, a second triggering event may advance the transition, and the transitionable seal may transition from sealing the bore 740" to unseal the bore 740". For example, in the configuration illustrated in FIG. 11A, the sleeve 880' seals the bore 740" of the housing 710" by blocking ports 885'. In some embodiments, the sleeve 880' may have a lid portion 781" and a stopper portion 785". There may be a recess 784" between the stopper portion 785" and the housing 710". In the illustrated embodiment, a spring element 788" is located in recess 784" of the housing 710", biasing the sleeve 880' towards the tail end 730" of the housing 710". The stopper portion 785" may sealingly fit in the bore 740". One or more O-rings 786" may be located around the stopper portion 785" to create a seal with the interior of the housing 710". Other configurations may be envisioned so that the sleeve 880' may seal the bore 740" of the housing 710". The sleeve 880' may be triggered to transition from a configuration wherein the sleeve 880' seals the bore 740" of the housing 710" to a configuration wherein sleeve 880' unseals the bore 740". For example, the sleeve 880' may unseal the bore 740" as in the configuration illustrated in FIG. 11D, wherein ports 885' are shown fluidly connected to bore 740" through sleeve passages 890'. As illustrated, housing 710" has four ports 885', and sleeve 880' has four sleeve passages 890', but various numbers, sizes, and distributions of ports 885' and sleeve passages 890' may be envisioned to accommodate operational requirements and designs. Further, other post-triggered configurations may be envisioned so that the sleeve 880' unseals the bore 740".

As with top latch-in plug 700, the transitionable seal of top latch-in plug 700" may be triggered to transition from sealing the bore 740" to unseal the bore 740", and the transitionable seal may seal the bore 740" at least until completion of the pressure test. In some embodiments, the completion of the pressure test may be indicated by a pressure-drop signal proximate the tail end 730" of the housing 710". For example, in the illustrated embodiment, the lid portion 781" of sleeve 880' may have one or more shear pin receptacles 783" for receiving shear pins 782". The shear pins 782" hold the sleeve 880' in the housing 710". The shear pins 782" are designed to shear in response to a selected pressure signal. The level of downhole pressure selected for the pressure signal to cause the shear pins 782" to shear may be near, at, or above the level of downhole pressure selected for the lowest pressure level of the pressure test. As illustrated, a first triggering event that initiates the transition of the transitionable seal may be a pressure signal, such as a selected downhole pressure that causes shearing of the shear pins 782". The pressure signal may compressing the stopper portion 785" against spring element 788". This may further compresses spring element 788" in the recess 784".

Figure 11A:
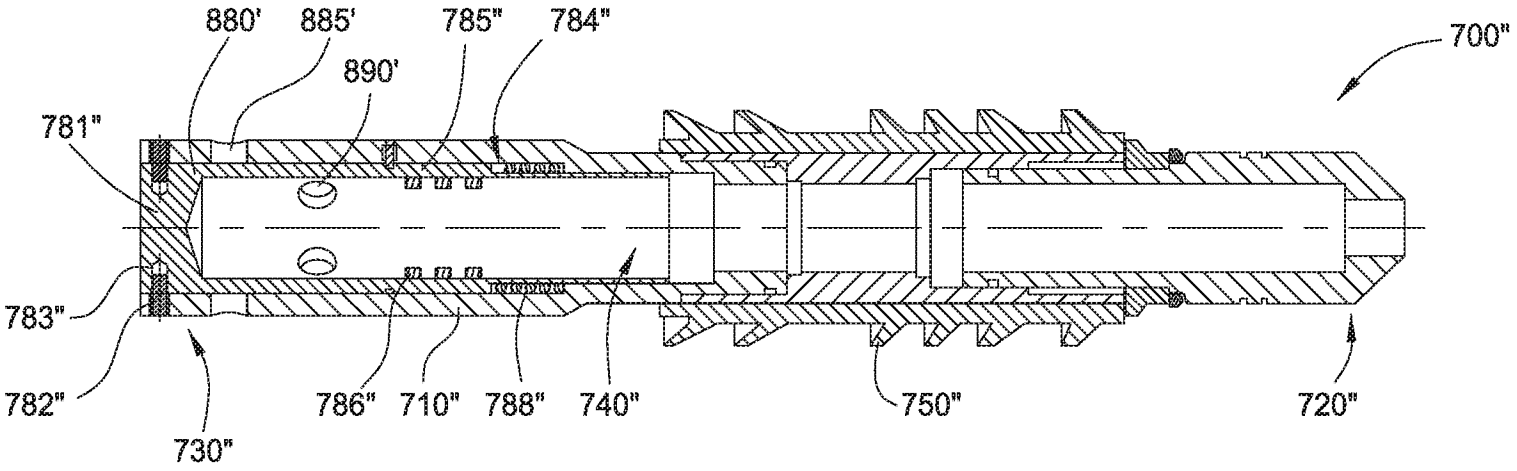
FIGS. 11 A-E illustrate another alternative top latch-in plug according to embodiments of the invention.
Figure 11B:
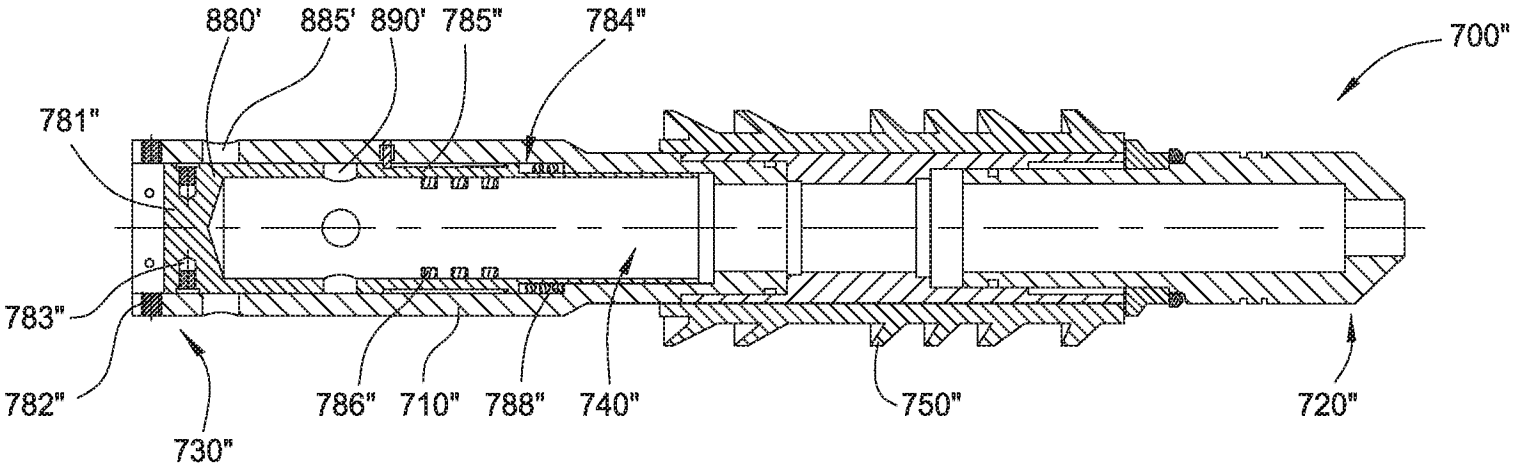
Figure 11C:
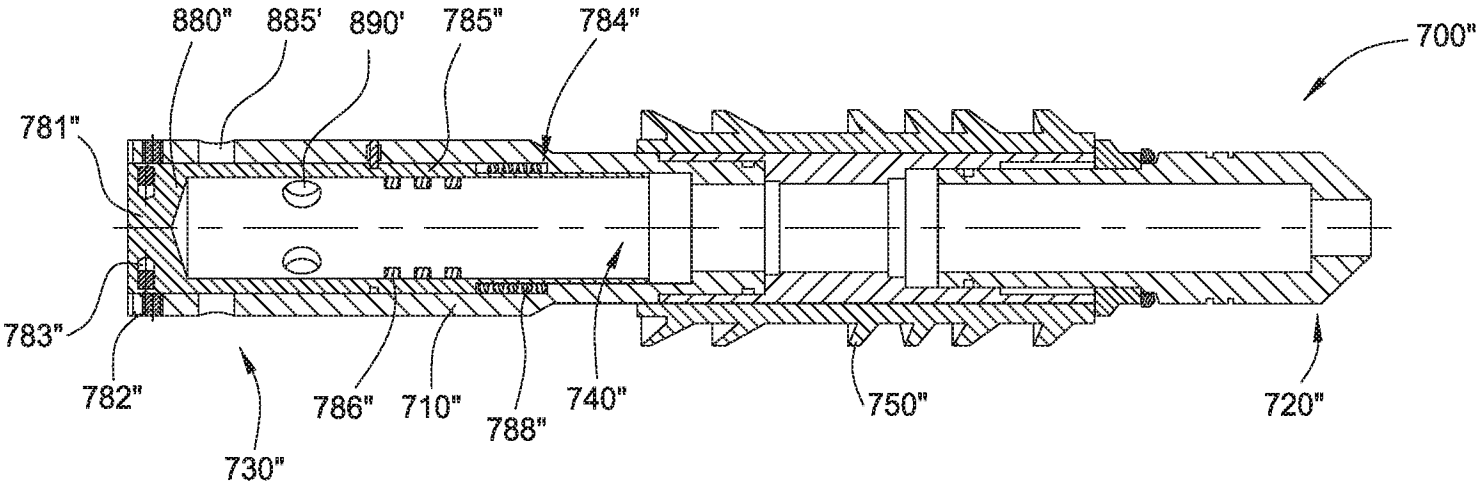
Figure 11D:
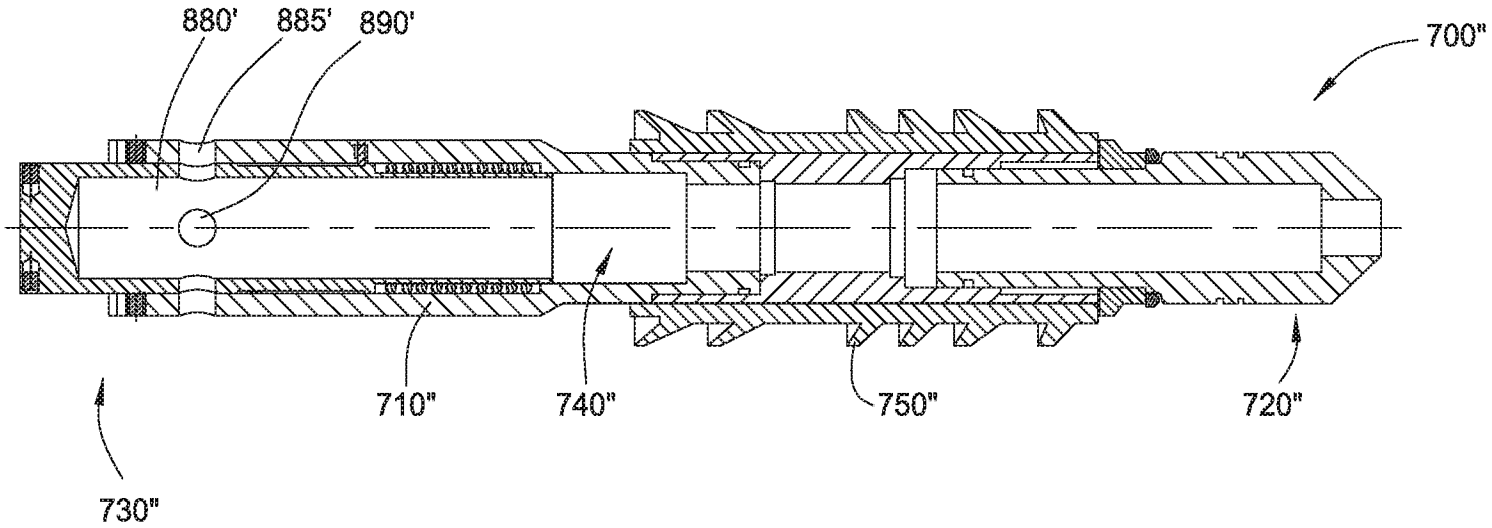
Figure 11E:
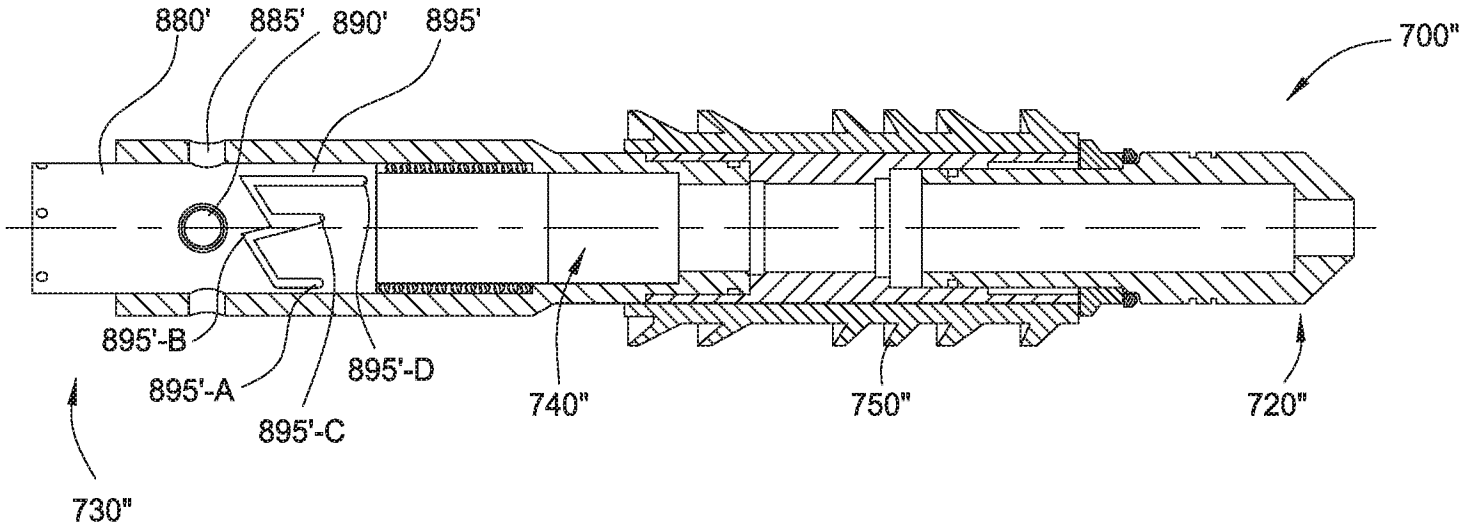
Figure 12:
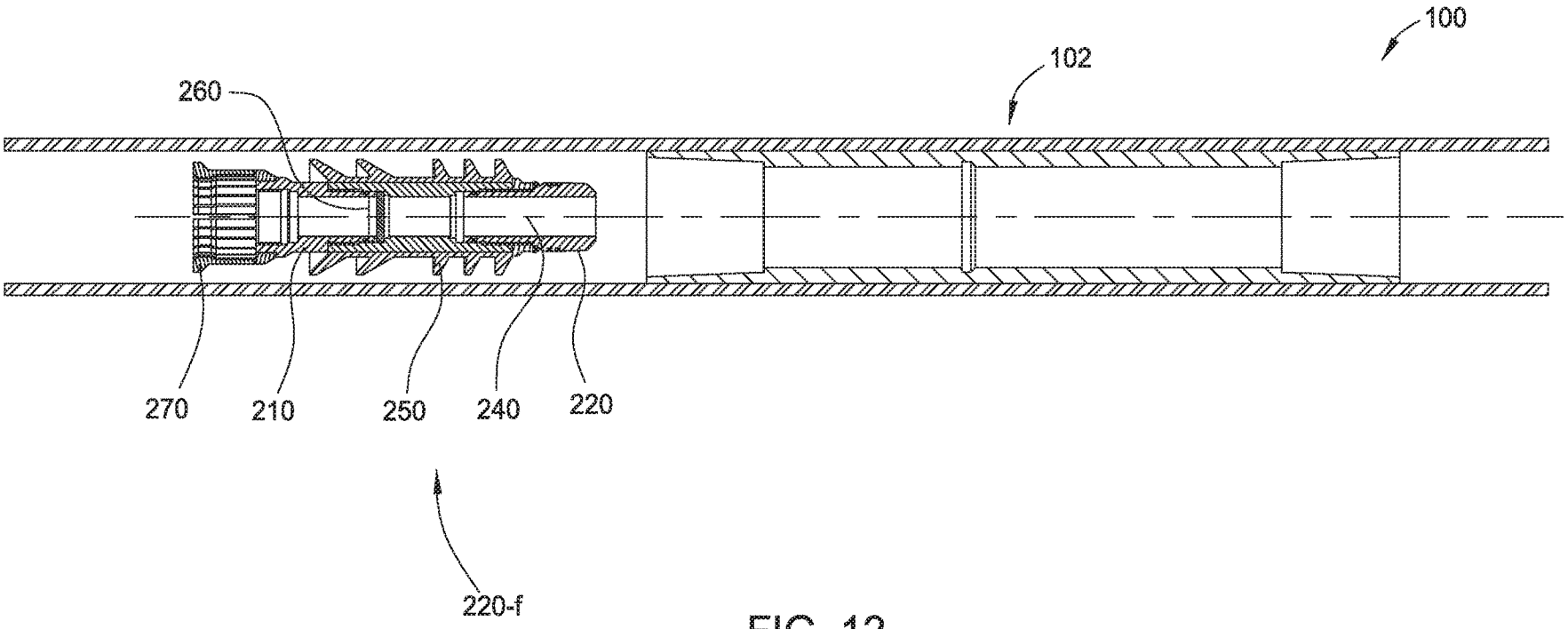
FIG. 12 illustrates a forward portion of a lower bottom latch-in plug according to embodiments of the invention.

As illustrated in FIG. 11E, there may be a multi-step J-slot 895' on the exterior of sleeve 880'. A pin on an interior surface of housing 710" may engage the J-slot 895'. In the initial configuration shown in FIG. 11A (when top latch-in plug 700" is introduced into and pumped down casing 100), the pin may engage J-slot 895' at point 895'-A. A first triggering event may initiate the transition of the transitionable seal by shearing shear pins 782". The first triggering event may further include moving the pin relative to J-slot 895' from point 895'-A to point 895'-B, thereby rotating sleeve 880' relative to housing 710". Sleeve 880' blocks ports 885' of housing 710" both with the pin in J-slot 895' at point 895'-A and with the pin in J-slot 895' at point 895'-B. Sleeve 880' thereby seals the bore 740" when the pin is in J-slot 895' at point 895'-A and at point 895'-B. In some embodiments, following the first triggering event, the downhole pressure may be increased, possibly in conjunction with a pressure test, thereby holding the pin in J-slot 895' point 895'-B (as illustrated in FIG. 11B). In some embodiments, the transitionable seal may thereby seal the bore of the housing in a post-triggered configuration. In some embodiments, the force of compressed spring element 788" is sufficient to overcome the downhole pressure and move the pin relative to J-slot 895' from point 895'-B to point 895'-C. Sleeve 880' may thereby further rotate relative to housing 710". In some embodiments, pumping pressure may be reduced to provide a pressure-drop signal, for example at the end of the pressure test, so that the force of compressed spring element 788" is sufficient to overcome the downhole pressure and move the pin to point 895'-C (as illustrated in FIG. 11C). In some embodiments, spring element 788" includes small charges, electromagnets, or other devices to provide impulsive force to assist in moving pin to point 895'-C. Sleeve 880' blocks ports 885' of housing 710" with the pin in J-slot 895' at point 895'-C, thereby sealing the bore 740".

A second triggering event may advance the transition of the transitionable seal by moving the pin relative to J-slot 895' from point 895'-C to point 895'-D, thereby further rotating sleeve 880' relative to housing 710". For example, a pressure signal or series of pressure signals may selectively move stopper portion 785" relative to housing 710" by alternatively decompressing and compressing spring element 788". As illustrated by J-slot 895', the pin moves relative to J-slot 895' from point 895'-C to point 895'-D with a single decompression followed by a single compression, but other J-slot configurations may be envisioned to respond to a variety of pressure signals to accommodate operational requirements and designs. The second triggering event may advance the transition by alternatively decompressing and compressing stopper portion 785" against spring element 788". As illustrated in FIG. 11D, when the pin is in J-slot 895' at point 895'-D, sleeve 880' aligns sleeve passages 890' with ports 885' of housing 710". Sleeve 880' thereby unseals the bore 740" subsequent to the second triggering event. In some embodiments, subsequent pressure signals (either pressure increases or pressure decreases) may further move the pin relative to the J-slot 895', thereby rotating sleeve 880' to either seal or unseal the bore 740" of the housing 710". A variety of other configurations may be envisioned so that, in conjunction with and/or following the pressure test, the transitionable seal may be triggered to transition from sealing the bore 740 to unseal the bore 740.

As would be appreciated by one of ordinary skill in the art with the benefit of this disclosure, more complex well completions could be conducted using a multiplicity of bottom latch-in plugs. For example, separation between various additional pumping fluids could be achieved with additional bottom latch-in plugs. Additional bottom latch-in plugs may also provide for additional wiping of the interior of the casing prior to cementing. The bottom latch-in plugs may be designed to sequentially latch-in, ultimately with the landing collar. Each bottom latch-in plug may have a pressure seal, wherein the downhole pressures selected to release each of the pressure seals may be incrementally increased, starting from the lowest bottom latch-in plug and increasing with each bottom latch-in plug in uphole sequence. Surface operations may detect and react to downhole pressure increases prior to each pressure seal release, providing information regarding the location of boundaries between various pumping fluids. It is currently believed that as many as 10 bottom latch-in plugs may be used. Likewise, more complex well completions could be conducted using a multiplicity of top latch-in plugs. Additional top latch-in plugs may also provide for additional wiping of the interior of the casing prior to production. However, only the uphole-most top latch-in plug may have a transitionable seal.

Figure 13:
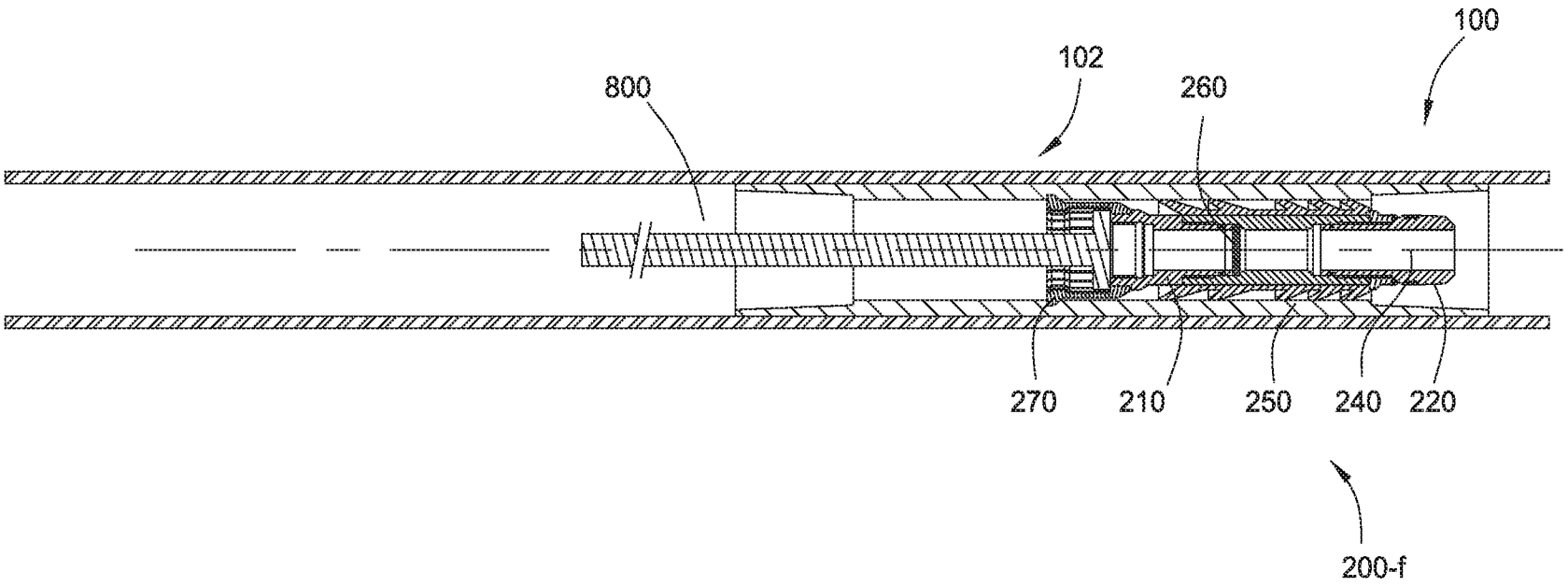
FIG. 13 illustrates a forward portion of a lower bottom latch-in plug proximate to a pre-load collar according to embodiments of the invention.
Figure 14:
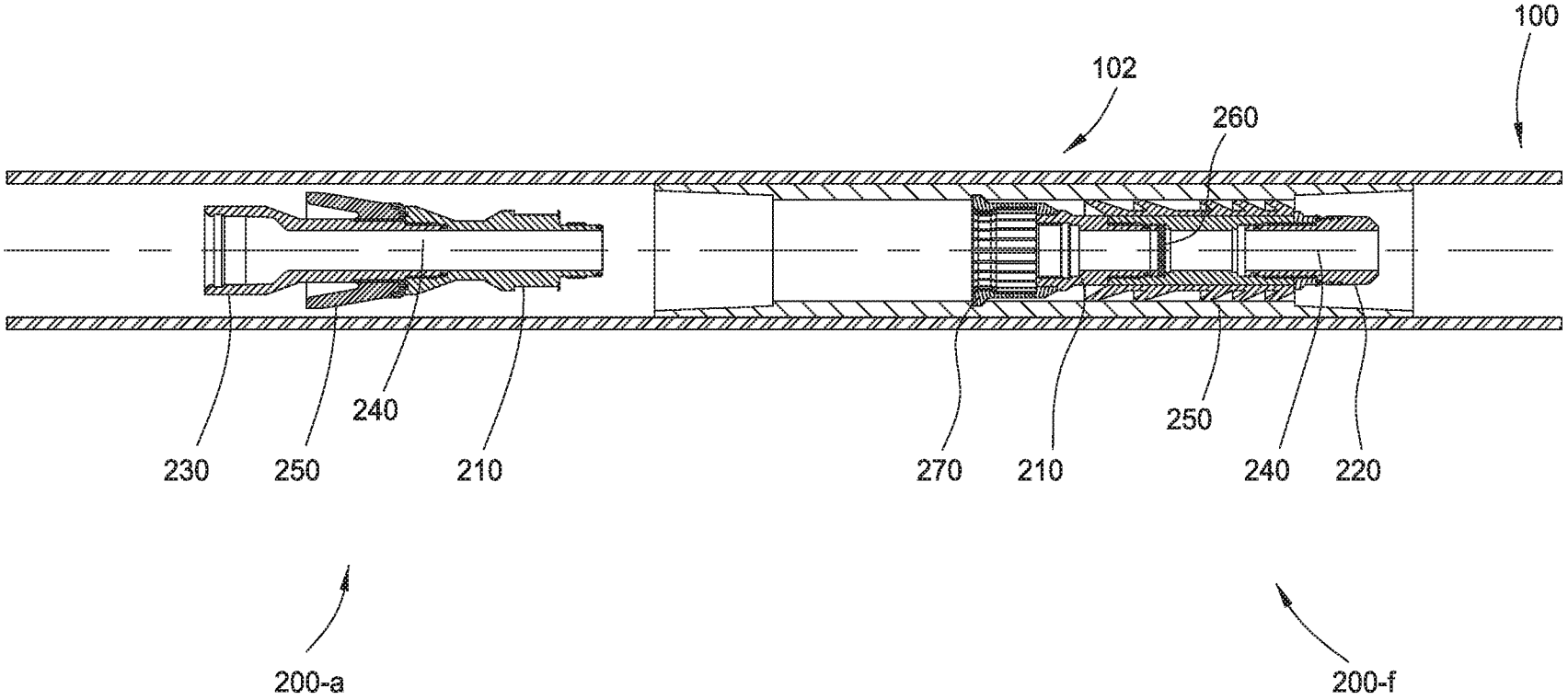
FIG. 14 illustrates an aft portion of a lower bottom latch-in plug according to embodiments of the invention.

In some embodiments, the lower bottom latch-in plug 200 may be assembled in the casing 100. For example, as illustrated in FIGS. 12-15, lower bottom latch-in plug 200 may include a forward portion 200-*f* (FIG. 12) and an aft portion 200-*a* (FIG. 14).

Forward portion 200-*f* may include housing 210, head end 220, bore 240, fins 250, pressure seal 260, and catch mechanism 270. Head end 220 may have a landing mechanism that is compatible with and/or configured to connect with landing collar 104. Forward portion 200-*f* is introduced, head end 220 first, into casing 100 behind the buoyancy fluid. Forward portion 200-*f* forms an uphole seal for the buoyancy fluid. In particular, fins 250 of forward portion 200-*f* contact and seal against the interior wall of casing 100, and pressure seal 260 of forward portion 200-*f* seals the bore 240 of forward portion 200-*f*. Once introduced into the casing 100, forward portion 200-*f* travels downhole through the casing 100, until reaching pre-load collar 102. Forward portion 200-*f* may travel downhole by gravity, by pumping of a pumping fluid behind the forward portion 200-*f*, or by an assembly tool 800 (FIG. 13). The catch mechanism 270 causes forward portion 200-*f* to be caught by the pre-load collar 102. In some embodiments, assembly tool 800 may actuate catch mechanism 270 to cause forward portion 200-*f* to be caught by the pre-load collar 102. As previously discussed, the buoyancy fluid may be introduced into the casing 100 while the casing 100 is at or near the surface of the wellbore. Therefore, assembly of bottom latch-in plug 200, including catching forward portion 200-*f* by the pre-load collar 102 to form an uphole seal for the buoyancy fluid, may also occur at or near the surface of the wellbore. Assembly tool 800 thus may be no longer than 5 meters.

Figure 15:
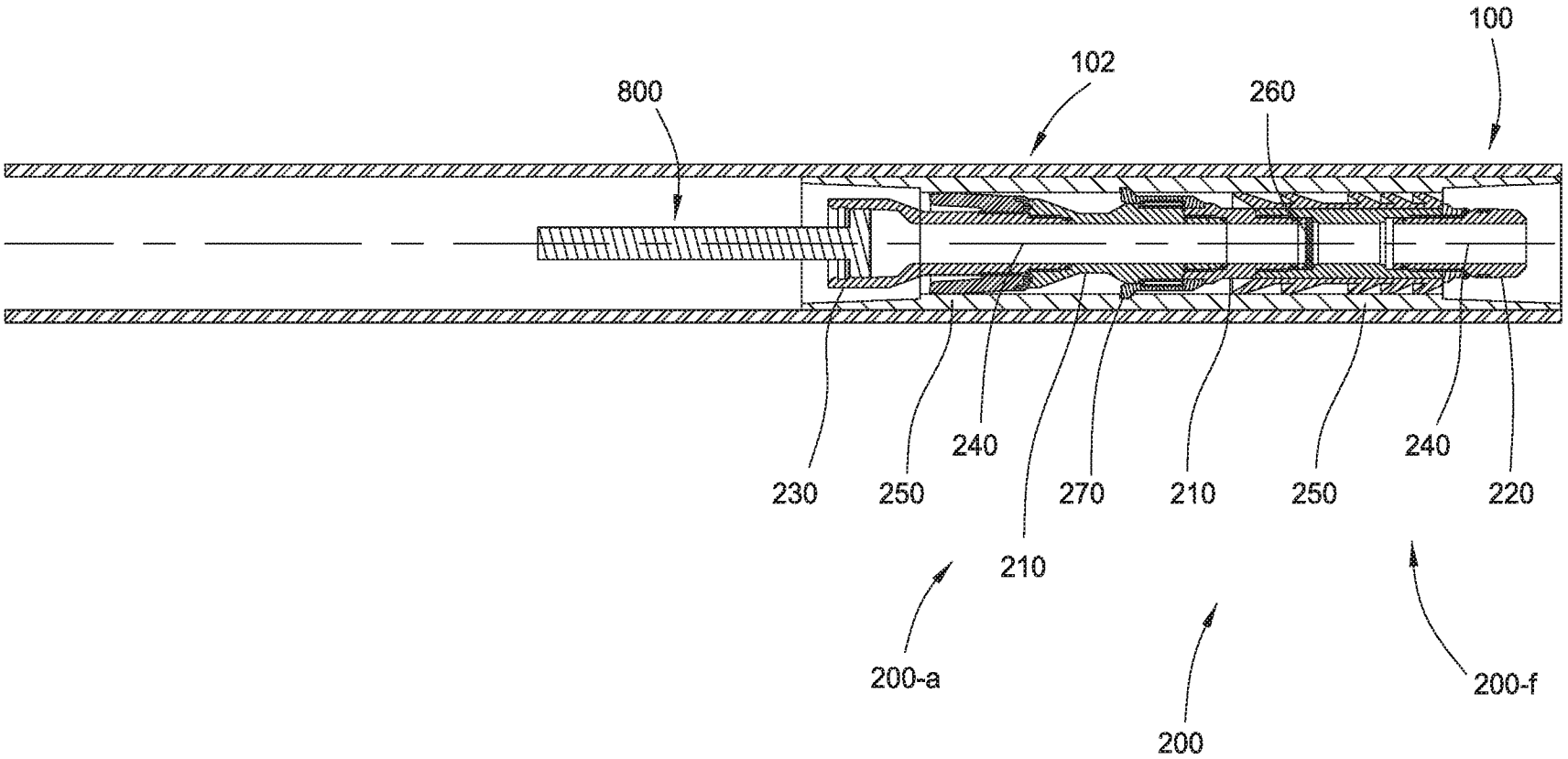
FIG. 15 illustrates an aft portion of a lower bottom latch-in plug proximate to a forward portion of a lower bottom latch-in plug according to embodiments of the invention.

Aft portion 200-*a* may include housing 210, tail end 230, bore 240, and fins 250. Tail end 230 may have a retaining mechanism to latch-in with other latch-in plugs. Aft portion 200-*a* is introduced, tail end 230 last, into casing 100 behind forward portion 200-*f*. Once introduced into the casing 100, aft portion 200-*a* travels downhole through the casing 100, until reaching forward portion 200-*f* at pre-load collar 102. Aft portion 200-*a* may travel downhole by gravity, by pumping of a pumping fluid behind the aft portion 200-*a*, or by an assembly tool 800 (FIG. 15). Aft portion 200-*a* is secured to forward portion 20-*f*. In some embodiments, assembly tool 800 may actuate a locking mechanism to cause aft portion 200-*a* to be secured to forward portion 200-*f*. In some embodiments, the locking mechanism may be similar to the previously-discussed retaining mechanism for latch-in plugs. Forward portion 200-*f* and aft portion 200-*a* may thereby form a unified lower bottom latch-in plug 200 that is caught in pre-load collar 102, forming an uphole seal for the buoyancy fluid.

Figure 16:
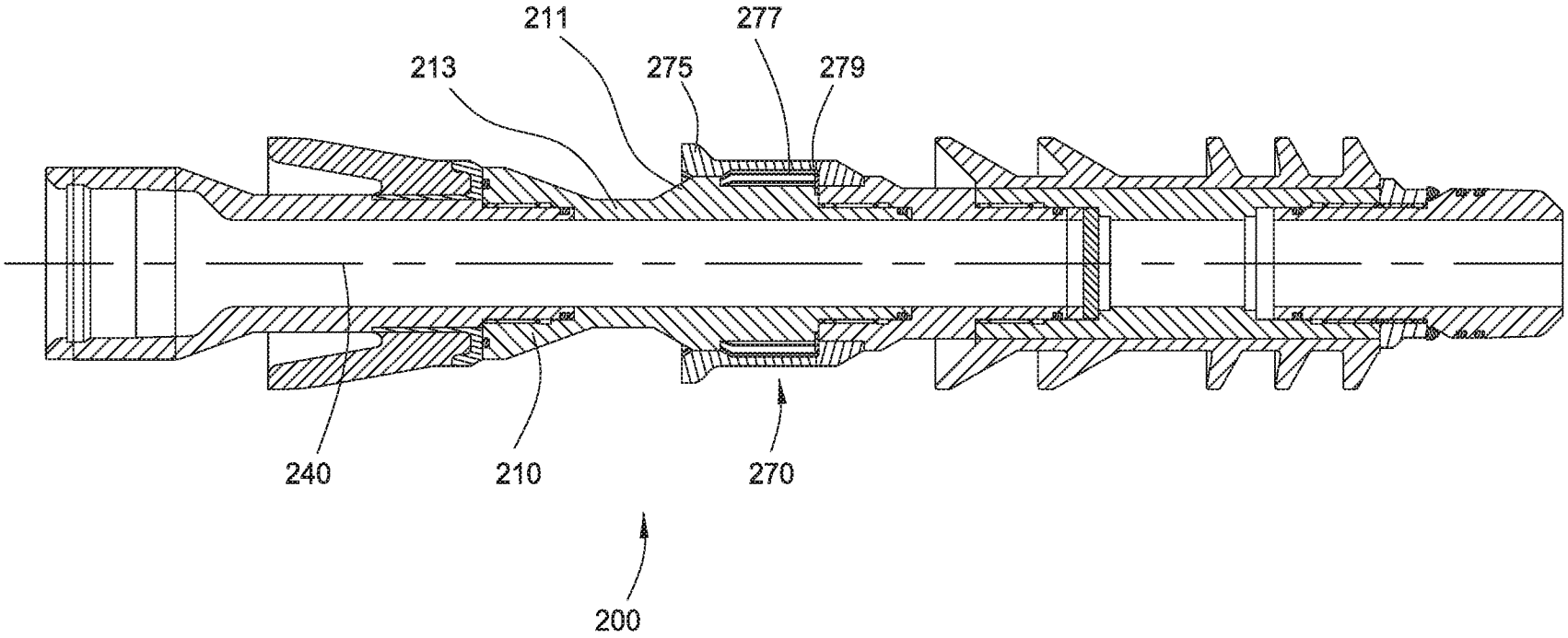
FIG. 16 illustrates a catch mechanism of a lower bottom latch-in plug according to embodiments of the invention.

As illustrated in FIG. 16, catch mechanism 270 of lower bottom latch-in plug 200 may be a collet 275 with a shear ring 279. In the illustrated embodiment, the housing 210 has a profile that includes a shoulder 211 and a waist 213, wherein the shoulder 211 has a larger diameter than the waist 213. In one configuration, the collet 275 is held open by the shoulder 211. When the collet 275 is held open, the collet 275 may be caught by pre-load collar 102. In another configuration, the collet 275 may be collapsed against the waist 213. When the collet 275 is collapsed, the lower bottom latch-in plug 200 may be released by the pre-load collar 102. Collet 275 may be prevented from collapsing against the waist 213 by shear ring 279. Downhole pressure applied to lower bottom latch-in plug 200 may cause shear ring 279 to shear. As previously discussed, the catch mechanism 270 may be designed to release (e.g., shear ring 279 shears) in response to a selected pressure signal. When shear ring 279 shears, collet 275 may be free to slide relative to housing 210, for example in groove 277. Collet 275 may thus transition from a configuration in which lower bottom latch-in plug 200 may be caught by pre-load collar 102 to a configuration in which lower bottom latch-in plug 200 may be released by pre-load collar 102. Other configurations may be envisioned so that catch mechanism 270 releases in response to a selected pressure signal. More specifically, other configurations may be envisioned that provide few or no obstructions in the interior of the casing 100 at the pre-load collar 102 after the lower bottom latch-in plug 200 is released.

Such methods and devices may provide a number of advantages, such as allowing a casing pressure test after cementing without additional trips or drilling before production. The latch-in plugs (sometimes referred to in the industry as "latch-down plugs") discussed herein may beneficially serve multiple functions, such as: separation of fluids inside of pipe; wiping of materials from the inner surface of pipe; operation of a downhole tool; surface indication of a downhole event; and formation of a temporary pressure barrier. A full-bore toe sleeve could also be used with this system. Use of the plugs in this system may improve wiping performance during displacement of cement, reducing the likelihood of a coil tubing cleanout run before well completions.

Casing floatation systems disclosed herein may be useful in locating a casing in a wellbore, especially if the wellbore is highly deviated. A method 921 of floating a casing into a wellbore is illustrated in FIG. 17B. In some embodiments, the method begins with disposing the casing in the wellbore at step 931. The casing may be at or near the surface of the wellbore, and only a downhole portion of the casing may be within the sidewalls of the wellbore at step 931. The casing may be constructed in segments, and only a subset of the segments may be disposed in the wellbore at step 931. The method continues as buoyancy fluid is disposed in the casing at step 932. The buoyancy fluid may be disposed between a pre-load collar and a landing collar. At step 933, the buoyancy fluid is sealed in the casing. The buoyancy fluid may be sealed between the pre-load collar and the landing collar. The casing may move downhole at step 934. In some embodiments, the casing may also move downhole while the buoyancy fluid is disposed in the casing at step 934'. In some embodiments, the method begins with disposing buoyancy fluid in the casing at step 932. For example, the casing may be constructed with a pre-load collar and a landing collar prior to introduction into the wellbore. The buoyancy fluid may be disposed between the pre-load collar and the landing collar prior to introduction of the casing into the wellbore. At step 933, the buoyancy fluid is sealed in the casing. The buoyancy fluid may be sealed between the pre-load collar and the landing collar. The casing may then be disposed in the wellbore at step 931, and moved downhole at step 934. The casing moves downhole until reaching a designated location. The method 921 of floating a casing into a wellbore completes and progresses to a next step of well completion at step 935 when the buoyancy fluid is discharged.

Figure 17A:
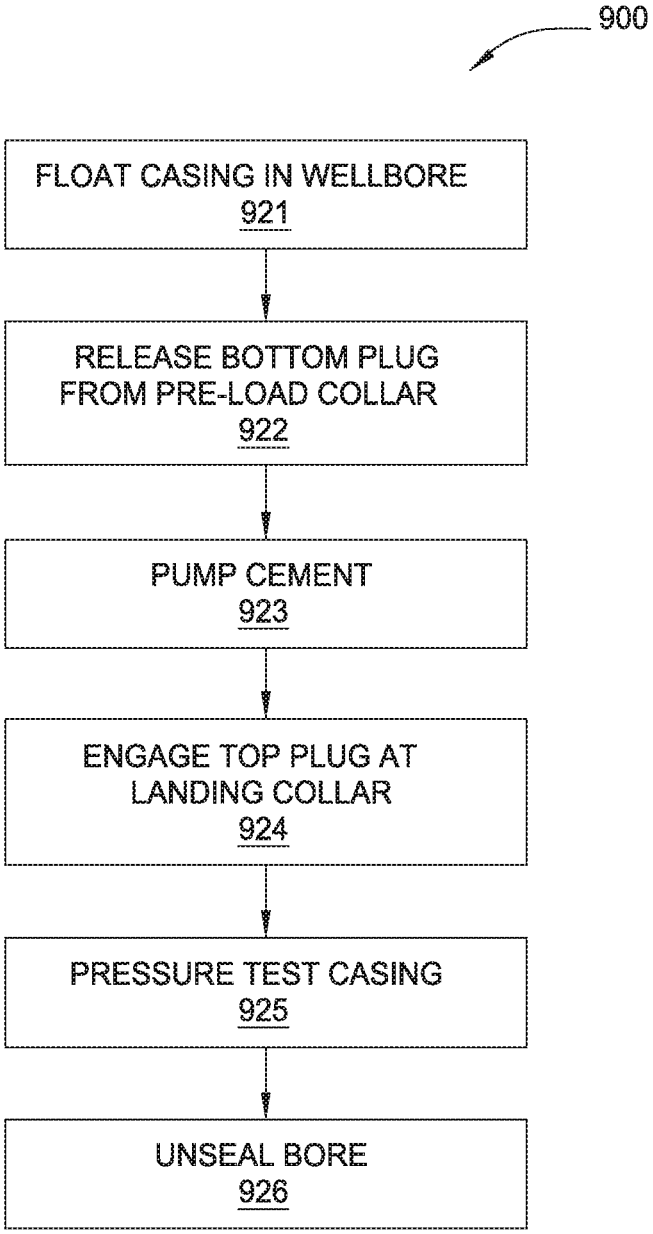
FIGS. 17 A-B illustrate methods of well completion according to embodiments of the invention.
Figure 17B:
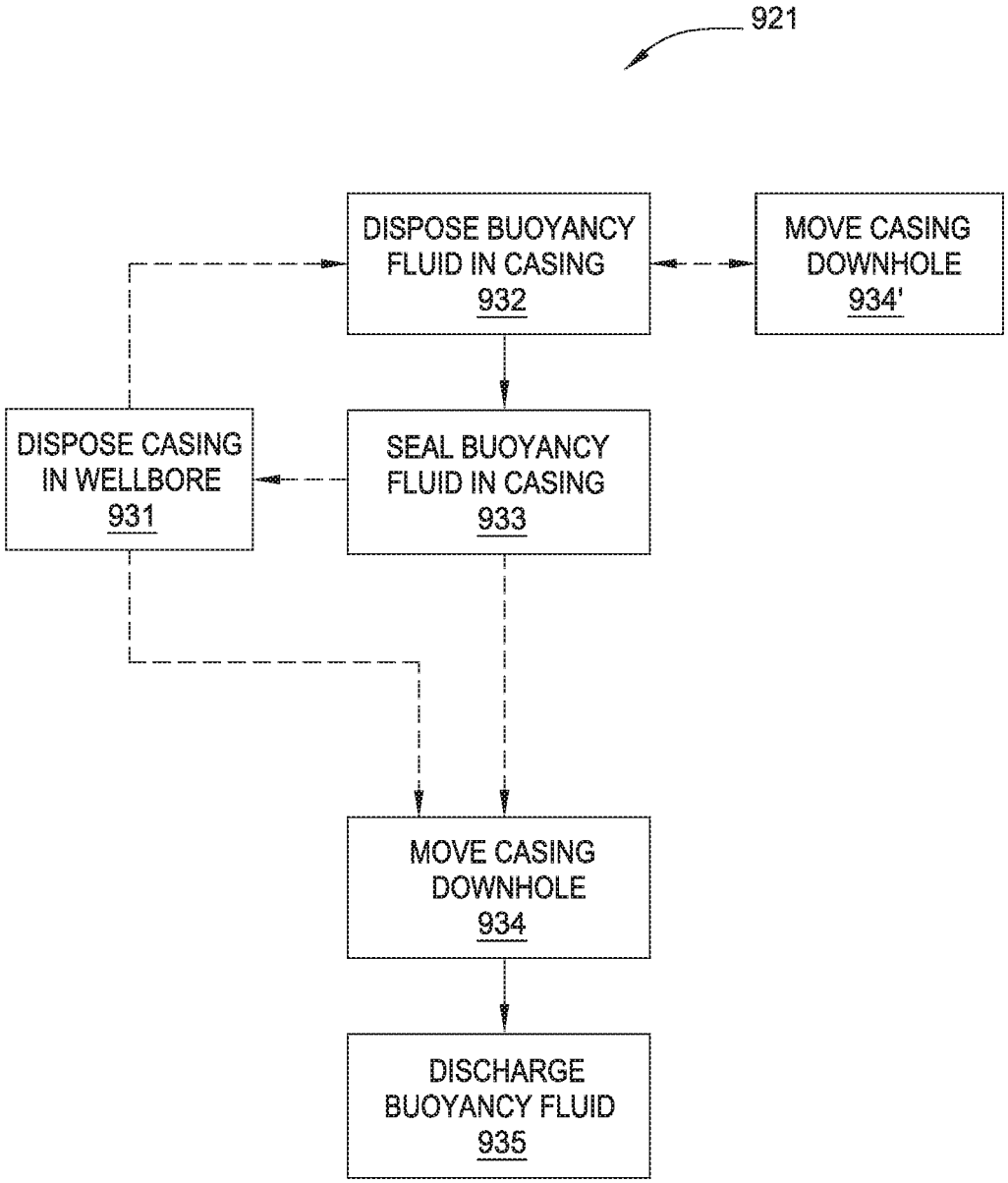

Method 921 of floating a casing into a wellbore may be useful in well completion operations, such as method 900 of well completion illustrated in FIG. 17A. Method 900 begins at step 921, floating a casing into a wellbore, as previously discussed. The casing may have a pre-load collar uphole from a landing collar. A bottom plug may be disposed at the pre-load collar. The method continues at step 922 when the bottom plug is released from the pre-load collar. The bottom plug may wipe the interior surface of the casing. In some embodiments, the bottom plug may travel downhole until it reaches the landing collar. The bottom plug may engage with the landing collar. At step 923, cement is pumped downhole through the casing. The cement may be pumped through the casing, the bottom plug, the landing collar, and a float shoe to enter and/or fill an annulus between the casing and the wellbore. Following pumping a desired amount of cement and/or displacement fluid, a top plug may be introduced into the casing. The top plug may include a transitionable seal. The top plug may travel downhole through the casing until reaching the landing collar and/or any plugs previously engaged with the landing collar. At step 924, the top plug may engage with the landing collar (or sequentially engage therewith via any plugs previously engaged with the landing collar). A pressure test of the casing may be conducted at step 925. In some embodiments, the pressure test may trigger the transitionable seal of the top plug to transition from a configuration sealing the bore of the top plug to a configuration unsealing the bore. At step 926, the bore of the top plug is unsealed, completing the well for production and/or further operations.

In an embodiment, a top latch-in plug includes a housing having: a head end; a tail end; and a bore from the head end to the tail end; and a transitionable seal, wherein: the transitionable seal seals the bore of the housing when in a first configuration, the transitionable seal unseals the bore when in a second configuration, and the transitionable seal is triggerable to transition from the first configuration to the second configuration.

In one or more embodiments disclosed herein, the transitionable seal seals the bore of the housing when in a post-triggered configuration.

In one or more embodiments disclosed herein, the transitionable seal is an expendable cap.

In one or more embodiments disclosed herein, the top latch-in plug also includes one or more shear pins holding the expendable cap in the housing when in the first configuration; and a spring element biased, when in the first configuration, to eject the expendable cap from the housing.

In one or more embodiments disclosed herein, the expendable cap transitions from the first configuration to the second configuration by forcibly ejecting from the housing.

In one or more embodiments disclosed herein, the expendable cap blocks no more than half of a cross-sectional area of the bore at the tail end of the housing when in the second configuration.

In one or more embodiments disclosed herein, the transitionable seal is a sleeve.

In one or more embodiments disclosed herein, the sleeve includes a plurality of sleeve passages that align with ports in the housing when in the second configuration; and a j-slot that engages with a pin of the housing.

In one or more embodiments disclosed herein, the transitionable seal is triggerable by a pressure signal.

In one or more embodiments disclosed herein, the transitionable seal is triggered to transition with multi-step triggering.

In one or more embodiments disclosed herein, the top latch-in plug also includes a recess between the transitionable seal and the housing when in the first configuration, wherein the transitionable seal enters the recess during transition between the first configuration and the second configuration.

In one or more embodiments disclosed herein, the transitionable seal comprises: a lid portion; one or more shear pin receptacles in the lid portion; a stopper portion; and one or more O-rings around the stopper portion.

In one or more embodiments disclosed herein, the transitionable seal transitions from the first configuration to the second configuration by at least partially dissolving.

In one or more embodiments disclosed herein, a pressure-drop signal causes the transitionable seal to unseal the bore.

In one or more embodiments disclosed herein, a multi-step pressure signal causes the transitionable seal to unseal the bore.

In an embodiment, a method of well completion includes floating a casing in a wellbore; pumping cement downhole through the casing to supply cement between the casing and the wellbore; sequentially engaging a lower bottom latch-in plug and a top latch-in plug to a landing collar of the casing, wherein the top latch-in plug includes a transitionable seal sealing a bore of the top latch-in plug; pressure testing the casing; and triggering the transitionable seal to unseal the bore of the top latch-in plug.

In one or more embodiments disclosed herein, the casing includes a pre-load collar located uphole from the landing collar; the method further comprising releasing the lower bottom latch-in plug from the pre-load collar.

In one or more embodiments disclosed herein, the transitionable seal is a cap.

In one or more embodiments disclosed herein, the transitionable seal is a sleeve.

In one or more embodiments disclosed herein, the transitionable seal seals the bore of the top latch-in plug at least until completion of the pressure testing.

In one or more embodiments disclosed herein, pressure testing the casing triggers the transitionable seal to unseal the bore of the top latch-in plug.

In one or more embodiments disclosed herein, a pressure-drop signal causes the transitionable seal to unseal the bore of the top latch-in plug.

In one or more embodiments disclosed herein, the pressure testing comprises increasing the downhole pressure; the increasing the downhole pressure triggers the transitionable seal; and the transitionable seal unseals the bore of the top latch-in plug after completion of the pressure testing.

In one or more embodiments disclosed herein, the triggering includes a first triggering event that initiates the transition, and a second triggering event that advance the transition.

In one or more embodiments disclosed herein, the triggering comprises a multi-step pressure signal.

In one or more embodiments disclosed herein, the method also includes, after pumping the cement and before sequentially engaging the lower bottom latch-in plug and the top latch-in plug to the landing collar, pumping an additional top latch-in plug downhole through the casing.

In one or more embodiments disclosed herein, the method also includes producing fluid from the wellbore through the casing.

In one or more embodiments disclosed herein, drilling does not occur between the triggering the transitionable seal and the producing fluid.

In one or more embodiments disclosed herein, the method also includes perforating the casing between the pre-load collar and the landing collar.

In one or more embodiments disclosed herein, the method also includes, after releasing the lower bottom latch-in plug and before pumping the cement, pumping an additional bottom latch-in plug downhole through the casing.

In an embodiment, a method of well completion includes causing a casing to be floated in a wellbore; causing cement to be pumped downhole through the casing to supply cement between the casing and the wellbore; sequentially engaging a lower bottom latch-in plug and a top latch-in plug to a landing collar of the casing, wherein the top latch-in plug includes a transitionable seal sealing a bore of the top latch-in plug; causing the casing to be pressure tested; and causing a triggering of the transitionable seal to unseal the bore of the top latch-in plug.

In an embodiment, a casing floatation system includes a casing having a pre-load collar and a landing collar; and a lower bottom latch-in plug comprising: a catch mechanism compatible with the pre-load collar; and a landing mechanism compatible with the landing collar.

In one or more embodiments disclosed herein, the catch mechanism comprises a collet with a shear ring.

In one or more embodiments disclosed herein, the lower bottom latch-in plug further comprises a pressure seal.

In one or more embodiments disclosed herein, the casing floatation system also includes an upper bottom latch-in plug comprising a pressure seal.

In one or more embodiments disclosed herein, the casing floatation system also includes a top latch-in plug having a transitionable seal.

In one or more embodiments disclosed herein, the transitionable seal is an expendable cap.

In one or more embodiments disclosed herein, the lower bottom latch-in plug pressure seal releases at a first pressure; the catch mechanism releases at a second pressure; the upper bottom latch-in plug pressure seal releases at a third pressure; the transitionable seal is triggerable by a pressure signal at a fourth pressure; and the first pressure is less than the second pressure, which is less than the third pressure.

In one or more embodiments disclosed herein, the third pressure is less than the fourth pressure.

In one or more embodiments disclosed herein, the catch mechanism releases in response to a pressure signal.

In one or more embodiments disclosed herein, upon release, the catch mechanism does not obstruct an interior of the casing at the pre-load collar.

In one or more embodiments disclosed herein, the casing floatation system also includes a plurality of bottom latch-in plugs.

In one or more embodiments disclosed herein, the casing floatation system also includes a float shoe with a check valve.

In one or more embodiments disclosed herein, the casing floatation system also includes one or more toe sleeves.

In one or more embodiments disclosed herein, the lower bottom latch-in plug pressure seal blocks a bore of the lower bottom latch-in plug when sealed.

In one or more embodiments disclosed herein, the upper bottom latch-in plug pressure seal blocks a bore of the upper bottom latch-in plug when sealed.

In one or more embodiments disclosed herein, one or more of the latch-in plugs has an anti-rotation feature.

In an embodiment, a method of well completion includes floating a casing in a wellbore, wherein the casing includes a pre-load collar located uphole from a landing collar, the floating the casing comprising: disposing the casing in the wellbore; disposing buoyancy fluid in the casing between the pre-load collar and the landing collar; and sealing the buoyancy fluid in the casing by engaging a lower bottom latch-in plug with the pre-load collar; discharging the buoyancy fluid from the casing; releasing the lower bottom latch-in plug from the pre-load collar; and engaging the lower bottom latch-in plug with the landing collar.

In one or more embodiments disclosed herein, the floating the casing further comprises moving the casing further downhole in the wellbore.

In one or more embodiments disclosed herein, the method also includes pumping cement downhole through the casing to supply cement between the casing and the wellbore; sequentially engaging a top latch-in plug with the bottom latch-in plug and the landing collar, wherein the top latch-in plug includes a transitionable seal sealing a bore of the top latch-in plug; pressure testing the casing; and triggering the transitionable seal to unseal the bore of the top latch-in plug.

In one or more embodiments disclosed herein, the method of also includes creating a first downhole pressure to discharge the buoyancy fluid from the casing.

In one or more embodiments disclosed herein, the lower bottom latch-in plug includes a pressure seal, and the first downhole pressure releases the pressure seal of the lower bottom latch-in plug.

In one or more embodiments disclosed herein, the method also includes, after discharging the buoyancy fluid from the casing and before releasing the lower bottom latch-in plug from the pre-load collar, engaging an upper bottom latch-in plug to the lower bottom latch-in plug.

In one or more embodiments disclosed herein, the method also includes creating a second downhole pressure to release the lower bottom latch-in plug from the pre-load collar.

In one or more embodiments disclosed herein, the lower bottom latch-in plug includes a catch mechanism, and the second downhole pressure releases the catch mechanism of the lower bottom latch-in plug.

In one or more embodiments disclosed herein, the catch mechanism includes a collet with a shear ring, and the second downhole pressure shears the shear ring.

In an embodiment, a method of assembling a latch-in plug includes obtaining a casing having a pre-load collar and a landing collar; disposing buoyancy fluid in the casing between the pre-load collar and the landing collar; catching a forward portion of a latch-in plug with the pre-load collar, thereby sealing the buoyancy fluid in the casing; and securing an aft portion of the latch-in plug to the forward portion.

In one or more embodiments disclosed herein, the forward portion has a landing mechanism that is compatible with the landing collar.

In one or more embodiments disclosed herein, the aft portion has a retaining mechanism to latch-in with other latch-in plugs.

In an embodiment, a method of well completion includes causing a casing to be floated in a wellbore, wherein: the casing includes a pre-load collar located uphole from a landing collar, and floating the casing comprises: disposing the casing in the wellbore; disposing buoyancy fluid in the casing between the pre-load collar and the landing collar; and sealing the buoyancy fluid in the casing by engaging a lower bottom latch-in plug with the pre-load collar; discharging the buoyancy fluid from the casing; causing a lower bottom latch-in plug to be released from the pre-load collar; and engaging the lower bottom latch-in plug with the landing collar.

In one or more embodiments disclosed herein, the floating the casing further comprises moving the casing further downhole in the wellbore.

While the foregoing is directed to embodiments of the present invention, other and further embodiments of the invention may be devised without departing from the basic scope thereof, and the scope thereof is determined by the claims that follow.

The invention claimed is:

1. A method of well completion comprising:

floating a casing in a wellbore;

engaging a first plug with a landing collar of the casing;

pumping cement downhole through the casing and the first plug to supply cement between the casing and the wellbore;

engaging a second plug with the first plug, wherein the second plug includes a transitionable seal sealing a bore of the second plug;

increasing a pressure in the casing to pressure test the casing; and decreasing the pressure in the casing to cause the transitionable seal to unseal the bore of the second plug.

2. The method of claim 1, wherein the transitionable seal includes at least one of a cap and a sleeve.

3. The method of claim 1, wherein the transitionable seal seals the bore of the second plug at least until completion of the pressure testing.

4. The method of claim 1, wherein pressure testing includes the decrease in the pressure.

5. The method of claim 1, wherein a pressure-drop signal includes the pressure decrease to cause the transitionable seal to unseal the bore of the second plug.

6. The method of claim 1, wherein:

the increasing the pressure shears at least one shearable member holding the transitionable seal in a position to block the bore of the second plug.

7. The method of claim 1, wherein the casing includes a pre-load collar located uphole from the landing collar, the method further comprising:

releasing the first plug from the pre-load collar.

8. The method of claim 1, further comprising:

after pumping the cement and before engaging the second plug to the first plug, pumping a third plug downhole through the casing.

9. The method of claim 7, further comprising:

perforating the casing between the pre-load collar and the landing collar.

10. The method of claim 7, further comprising, after releasing the first plug and before pumping the cement and engaging the second plug with the first plug, pumping a third plug downhole through the casing.

11. A method of well completion comprising:

causing a casing to be floated in a wellbore;

causing cement to be pumped downhole through the casing to supply cement between the casing and the wellbore;

sequentially engaging a first plug with an uphole end of a second plug in the casing, wherein the first plug includes:

a housing;

a flow path; and a transitionable seal moveable from a first position to a second position, wherein the flow path is blocked by the transitionable seal in the first position and unblocked by the transitionable seal in the second position; and decreasing pressure of a wellbore fluid above the transitionable seal to move the transitionable seal from the first position to the second position.

12. The method of claim 11, wherein the transitionable seal includes at least one of a cap and a sleeve.

13. The method of claim 11, wherein the transitionable seal blocks the flow path until the completion of a pressure test.

14. The method of 11, wherein the second plug is engaged with an uphole end of a third plug.

15. The method of claim 11, further comprising:

increasing pressure of the wellbore fluid above the transitionable seal to move the transitionable seal from a third position to the first position, wherein the flow path is blocked when the transitionable seal is in the third position.

16. A method of well completion comprising:

landing a plug in a casing, the plug including a transitionable seal partially disposed outside a housing, the housing including a flow path, the transitionable seal blocking the flow path;

increasing a fluid pressure uphole of the landed plug to perform a pressure test; and decreasing the fluid pressure to move the transitionable seal to open the flow path to allow fluid uphole of the landed plug to flow through the open flow path.

17. The method of claim 16, wherein increasing the fluid pressure causes the transitionable seal to move from a first position to a second position, wherein the flow path is blocked when the transitionable seal is in the first position and second position.

18. The method of claim 17, wherein decreasing the fluid pressure causes the transitionable seal to move from the second position to a third position.

19. The method of claim 16, wherein the landed plug is a first plug, and wherein a second plug is landed in the casing prior to landing the first plug.

20. The method of claim 16, wherein increasing the fluid pressure includes increasing the fluid pressure to a level above a biasing force applied to the transitionable seal.

21. The method of claim 20, wherein decreasing the fluid pressure includes decreasing the fluid pressure to a level below the biasing force applied to the transitionable seal.

22. A method of well completion comprising:

landing a plug in a casing, the landed plug including:

a transitionable seal partially disposed outside a housing and blocking a flow path;

increasing a fluid pressure uphole of the landed plug to perform a pressure test, wherein increasing the fluid pressure causes the transitionable seal to move from a first position to a second position, wherein the flow path is blocked when the transitionable seal is in the first position and second position; and decreasing the fluid pressure to move the transitionable seal to open the flow path.

23. The method of claim 22, wherein decreasing the fluid pressure causes the transitionable seal to move from the second position to a third position.

24. A method of well completion comprising:

landing a plug in a casing, the landed plug including a biasing member and a transitionable seal blocking a flow path, wherein the transitionable seal includes a first portion and a second portion, and wherein second portion is at least partially disposed within the biasing member;

increasing a fluid pressure uphole of the landed plug to perform a pressure test, wherein increasing the fluid pressure includes increasing the fluid pressure to a level above a biasing force applied to the transitionable seal by the biasing member; and decreasing the fluid pressure below the biasing force such that the biasing member moves the transitionable seal to open the flow path.

25. The method of claim 16, wherein the flow path is a bore formed in the housing and at least one port formed the housing.

26. The method of claim 22, wherein the transitionable seal is a cap having a lid portion and a stopper portion, wherein the stopper portion blocks the flow path in the first and second positions.

* * * * *